US006164561A

United States Patent [19]

Yoshida et al.

[11] Patent Number: 6,164,561

[45] Date of Patent: Dec. 26, 2000

[54] ROTARY ATOMIZING HEAD TYPE COATING DEVICE

[75] Inventors: Osamu Yoshida; Hidetsugu Matsuda; Toshio Hosoda, all of Tokyo, Japan

[73] Assignee: ABB K.K., Tokyo, Japan

[21] Appl. No.: 09/380,586

[22] PCT Filed: Dec. 28, 1998

[86] PCT No.: PCT/JP98/05993

§ 371 Date: Sep. 9, 1999

§ 102(e) Date: Sep. 9, 1999

[87] PCT Pub. No.: WO99/36182

PCT Pub. Date: Jul. 22, 1999

[30] Foreign Application Priority Data

Jan. 13, 1998 [JP] Japan ..... 10-018226

[51] Int. Cl.[7] ..... B05B 3/10; B05B 5/00

[52] U.S. Cl. ..... 239/223; 239/104; 239/322; 239/329; 239/600; 239/583; 239/700; 222/148; 222/326; 222/389; 901/43

[58] Field of Search ..... 239/104, 106, 239/124, 223, 224, 320, 322, 323, 329, 290, 700, 703, 708, 600, DIG. 14, 583; 222/148, 325, 326, 327, 386, 389; 901/43

[56] References Cited

U.S. PATENT DOCUMENTS

| | | | |
|---|---|---|---|
| 4,555,058 | 11/1985 | Weinstein et al. | 239/223 |
| 4,813,603 | 3/1989 | Takeuchi et al. | 239/223 X |
| 5,221,050 | 6/1993 | Jeffries et al. | 239/323 X |
| 5,310,120 | 5/1994 | Ehinger et al. | 222/389 X |
| 5,704,977 | 1/1998 | Baumann et al. | 239/708 X |
| 5,727,735 | 3/1998 | Baumann et al. | 239/124 X |
| 5,788,164 | 8/1998 | Tomita et al. | 239/223 X |

FOREIGN PATENT DOCUMENTS

| | | |
|---|---|---|
| 6-134354 | 5/1994 | Japan . |
| 7-323245 | 9/1996 | Japan . |
| 8-229442 | 9/1996 | Japan . |
| 8-229446 | 9/1996 | Japan . |

*Primary Examiner*—Andres Kashnikow
*Assistant Examiner*—Steven J. Ganey
*Attorney, Agent, or Firm*—Oblon, Spivak, McClelland, Maier & Neustadt, P.C.

[57] ABSTRACT

By provision of paint cartridges of different colors which are detachably mounted on a coating system, the paint can be changed from one color to another in a multi-color coating operation without necessitating to discharge residues of a previous color. The paint cartridge of each color is replaceably mounted on a housing. Each cartridge is provided with a paint valve (46) which functions to communicate and shut off a paint supply passage in a feed tube. In addition, a thinner valve which serves to communicate and shut off a thinner passage on the housing is provided either on the side of the housing or on the side of the cartridge. These arrangements make it possible to cope with multiple color changes on one coating system. Since both of the paint valve and thinner valve are opened and closed by spray-on and spray-off command signals, respectively, the paint spray can be turned on and off immediately in response to these command signals.

15 Claims, 13 Drawing Sheets

ROTARY ATOMIZING HEAD TYPE COATING DEVICE

BACKGROUND OF THE INVENTION

1. Field of the Invention

This invention relates to a rotary atomizing head type coating system, particularly suitable for use, for example, in coating operations on vehicle bodies or the like which require changes of paint colors.

2. Discussion of the Background

Generally, rotary atomizing head type coating systems have been in wide use for coating vehicle bodies and the like. In connection with coating operations of this sort, recent demands are mostly focused on measures for reducing the amounts of paint and solvent which have to be discarded as waste each time when changing the paint color as well as on measures for coping with as many color changes as possible in the course of a coating operation.

In this regard, Japanese Laid-Open Patent Publication No. H8-229446 discloses a rotary atomizing head type coating system which is provided with measures for reducing the amounts of waste paint and solvent, and which can cope with an increased number of paint colors. This rotary atomizing head type coating system employs paint cartridges of different colors which can be replaceably set in position within a housing together with a coating machine unit.

Further, the prior art rotary atomizing head type coating system is generally composed of a housing which is provided with a coating machine mount portion and a cartridge mount portion in its front and rear portions, respectively, and a coating machine which is mounted in the coating machine mount portion, including an air motor with a rotational shaft and a rotary atomizing head which is mounted on a fore end portion of the rotational shaft of the air motor. Provided internally of and axially through the rotational shaft of the air motor, which constitutes the coating machine, is a feed tube passage having its fore and rear ends opened into the rotary atomizing head and the cartridge mount portion, respectively.

The coating system is equipped with paint cartridges of different colors which are selectively and replaceably mounted on the cartridge mount portion of the housing. Each one of the paint cartridges is constituted by a cylinder which is filled with paint and a feed tube which is extended axially forward from the fore distal end of the cartridge cylinder. The cartridge cylinder is replaceably set in position within the cartridge mount portion on the housing, while the feed tube is passed through the above-mentioned feed tube passage.

The paint cartridge is further provided with a movable partition wall defining within the cartridge cylinder a paint reservoir chamber in communication with the feed tube and a paint-extruding air chamber, and an air passage which supplies paint-extruding air to the air chamber. In addition, to and in communication with the air passage on the side of the cartridge, an air passage is also provided on the side of the housing. Through the air passage on the side of the housing and the air passage on the side of the cartridge, paint-extruding air is circulated to the paint-extruding air chamber to displace the movable partition wall forward, thereby pushing the paint in the paint reservoir chamber into the rotary atomizing head through the feed tube.

In the case of the prior art rotary atomizing head type coating system which is arranged in the above-described manner, a paint cartridge of a particular color, which is selected from a number of cartridges of different colors, is mounted on the cartridge mount portion in the housing. Then, air is supplied to the paint-extruding air chamber of the cartridge under suitable pressure to push forward the paint in the paint reservoir chamber of the paint cartridge into the feed tube for supplying to the rotary atomizing head, which sprays the supplied paint over an article to be coated.

The paint color can be changed simply by replacing the cartridge on the machine by other paint cartridge of a different color, without necessitating to discard waste paint and solvent.

During a coating operation, the rotary atomizing head type coating system according to the above-described prior art is put in reciprocating movements and at the same time its position is successively shifted in a direction perpendicular to the direction of reciprocating movements. At this time, in order to maintain a uniform thickness of the coating film, the movement of the coating system is reversed at positions outside a coating surface of work. Besides, as the coating system comes to a position outside a coating surface, the supply of air to an air chamber of the paint cartridge is cut off to break the paint supply to the rotary atomizing head, thereby temporarily stopping paint spraying from the atomizer head.

However, even if the air supply is cut off to stop paint spraying, it is often the case that the air passages and air chamber remain in a pressurized state for some time after the air supply is cut off. Therefore, during that time period, the movable partition wall is displaced to continue the paint supply to the rotary atomizing head until the air passages and air chamber as well as the paint reservoir chamber and the feed tube settle down to a static pressure level.

Accordingly, after dispatching a command signal to stop the paint supply, there is always a time lag until the paint supply actually comes to a stop. This gives rise to various problems, for instance, such as wasteful paint consumption, paint depositions on unnecessary portions of coating surfaces, and irregularities in thickness of a coated film which would invite degradations in quality of the coating.

Further, when a paint cartridge is extracted from the housing for replacement, the residual paint which drips from the feed tube may fall on a coated surface to become a cause of coating defects.

Furthermore, the prior art coating system employs paint-extruding air for displacing the movable partition wall in the cartridge cylinder. However, a compressed fluid like air is apt to undergo variations in volume while being supplied to the extruding air chamber. Therefore, it is usually required to provide a flowmeter and various control valves additionally on the coating system in order to ensure accurate paint supply at the time of a coating operation, resulting in increases in size and running cost of the coating system.

SUMMARY OF THE INVENTION

In view of the problems of the prior art as described above, it is an object of the present invention to provide a rotary atomizing head type coating system which is capable of controlling paint spraying and stopping actions accurately by turning on and off the paint supply definitely in an assured manner.

It is another object of the present invention to provide a rotary atomizing head type coating system which can maintain a constant coating thickness and which can prevent paint dripping to ensure quality coatings.

In accordance with the present invention, there is provided a rotary atomizing head type coating system of the type which basically includes: a housing having a coating machine mount portion on the front side and a cartridge mount portion on the rear side thereof; a coating machine adapted to be mounted on the coating machine mount portion of the housing, and having an air motor with a rotational shaft and a rotary atomizing head mounted on a front end portion of the air motor; a feed tube passage hole provided internally of and axially through the rotational shaft of the air motor, and having a front end opened into the rotary atomizing head and a rear end opened into the cartridge mount portion of the housing; and a plural number of paint cartridges containing paint of different colors in respective cartridge cylinders, each one of the paint cartridges being adapted to be selectively and detachably loaded on the cartridge mount portion of the housing and having a feed tube extended axially forward from a front end portion of the cartridge cylinder for placement in the feed tube passage hole.

In order to solve the above-described problems, the rotary atomizing head type coating system according to the present invention is characterized by the provision of: on the side of the paint cartridge, a movable partition wall dividing the cylinder into a paint reservoir chamber in communication with the feed tube and an extruding liquid chamber, an extruding liquid passage for supplying an extruding liquid to the extruding liquid chamber, and a paint valve to turn on and off paint supply from the feed tube to the rotary atomizing head; on the side of the housing, an extruding liquid passage in communication with the extruding liquid passage on the cartridge; and an extruding liquid valve provided within the length of the extruding liquid passage either on the side of the cartridge or on the side of the housing to turn on and off extruding liquid supply to the extruding liquid chamber.

With the arrangements just described, a paint cartridge is loaded on the cartridge mount portion of the housing prior to a coating operation, with the feed tube of the cartridge placed in the feed tube passage hole which is formed internally of the rotational shaft of the air motor. Then, the paint valve and the extruding liquid valve are opened, thereby displacing the movable partition wall by an extruding liquid which is introduced into the extruding liquid chamber in the cartridge through the extruding liquid passage on the side of the housing and the extruding liquid passage on the side of the cartridge. As the movable partition wall is displaced in this manner, the paint which is filled in the cartridge is pushed forward and delivered to the rotary atomizing head through the feed tube. On the other hand, since the rotary atomizing head is put in high speed rotation by the air motor, the supplied paint is atomized into fine particles and sprayed toward a coating object.

During a coating operation, the paint spray is usually turned on and off repeatedly depending upon the shapes of coating surfaces. For stopping or turning off the paint spray, the paint valve is closed to shut off the paint supply passage in the feed tube to hold the paint supply from the paint reservoir chamber to the rotary atomizing head. At the same time, the extruding liquid valve is closed to shut off the extruding liquid passage on the side of the housing or on the side of the paint cartridge to stop the supply of extruding liquid to the extruding liquid chamber. Therefore, when stopping the paint spray, the paint supply is immediately cut off by closure of the paint valve, and at the same time the supply of the extruding liquid is similarly immediately cut off by closure of the extruding liquid valve, making it possible to turn on and off the paint supply to the rotary atomizing head definitely in a reliable manner.

Further, when changing the paint color, a coating operation in a new color can be started simply after replacing a paint cartridge on the cartridge mount portion of the housing by a paint cartridge of a new color. During the cartridge replacement, the paint supply passage in the feed tube is shut off by the paint valve to prevent the paint from dripping from the feed tube.

In this instance, according to the present invention, it is preferred that the coating system further comprises an extruding liquid feeding means which is connected to the extruding liquid passage on the side of the housing to supply an extruding liquid quantitatively to the cartridge. With these arrangements, the movable partition wall is displaced by an extruding liquid, which is quantitatively fed to the extruding liquid chamber from the extruding liquid feeding means via the extruding liquid passage on the side of the housing and the extruding liquid passage on the side of the cartridge, to supply paint quantitatively from the feed tube to the rotary atomizing head.

According to the present invention, the coating system may further comprise a coating robot with vertical and horizontal arms, having the housing of the coating system mounted on a fore end portion of the horizontal arm of the coating robot while having the extruding liquid feeding means mounted on the vertical arm of the coating robot. With these arrangements, the extruding liquid feeding means can be located in a position in the vicinity of the housing and cartridge, which would neither put much burden on the coating robot nor require lengthy piping work.

Further, in one preferred form of the present invention, the extruding liquid feeding means is in the form of a positive displacement pump means constituted by a piston type pump having a cylinder and a piston, and a servo motor for displacing the piston within the cylinder of the pump.

With the arrangements just described, by rotating the servo motor at a predetermined rotational speed, the piston of the piston type pump can be displaced according to the rotational speed of the motor to feed the extruding liquid in the cylinder quantitatively to the cartridge.

Further, according to the present invention, preferably the extruding liquid feeding means comprises, in a fore end portion of the cylinder of the piston type pump and in communication with each other, an extruding liquid supply conduit connected to the extruding liquid passage on the side of the housing, an extruding liquid replenishing conduit connected to an extruding liquid source, and a drain conduit connected to a drain side, the extruding liquid supply conduit being provided with an extruding liquid supply valve to be opened only when the extruding liquid in the cylinder is supplied to the paint cartridge, the extruding liquid replenishing conduit being provided with a liquid replenishing valve to be opened only when the extruding liquid is replenished to the cylinder, and the drain conduit being provided with an air bubble extraction valve to be opened only when removing air bubbles from an extruding liquid replenished to the cylinder.

With the arrangements just described, among the extruding liquid valve, the extruding liquid replenishing valve and the air bubble extraction valve of the extruding liquid feeding means, when the extruding liquid valve alone is opened, the extruding liquid within the cylinder can be supplied to the paint cartridge through the extruding liquid supply conduit. On the other hand, when the extruding liquid replenishing valve is opened, the extruding liquid can be replenished to the cylinder through the extruding liquid replenishing conduit. Further, when the air bubble extraction valve is opened, air bubbles which are trapped in the extruding liquid within the cylinder can be removed or expelled to the outside through the drain conduit.

Further, in another preferred form of the present invention, the extruding liquid feeding means is in the form of a positive displacement pump means constituted by a gear pump, and a servo motor which rotationally drives the gear pump. In this case, by rotating the servo motor at a predetermined rotational speed, the extruding liquid in the cylinder can be quantitatively supplied to the cartridge.

Further, according to the present invention, the paint valve and the extruding liquid valve are adapted to be open and close in synchronism with start and stop of the servo motor. With these arrangements, the paint valve and the extruding liquid valve can be controlled to open and close precisely and accurately in timed relation with start and stop of the servo motor. Accordingly, it also becomes possible to prevent paint drips from the feed tube which would otherwise occur due to residual pressures in the cylinder or other parts of the machine.

Further, according to the present invention, the paint valve is arranged as an air pilot operated control valve which is normally biased in a closing direction by a valve spring and adapted to open upon applying pilot air thereto from outside to open a paint flow through the feed tube. With these arrangements, the valve body of the paint valve is normally closed by the biasing force of the valve spring to shut off the paint supply passage. On the other hand, upon supply of pilot air, the valve body is opened against the biasing force of the valve spring to open a paint flow through the feed tube.

Further, according to the present invention, the extruding liquid valve is arranged as an air pilot operated control valve which is normally biased in a closing direction by a valve spring and opened upon application of pilot air thereto from outside to open an extruding liquid flow through the extruding liquid passage.

With the arrangements just described, the valve body of the extruding liquid is normally closed by the biasing force of the valve spring to shut off the extruding liquid passage. On the other hand, upon supply of pilot air, the valve body is opened against the biasing force of the valve spring to open an extruding liquid flow through the extruding liquid passage.

Further, according to the present invention, the cartridge mount portion of said housing is provided with a positioning coupler portion for engagement with a complementarily shaped positioning coupler portion on a front end portion of the cylinder of the paint cartridge.

With the arrangements just described, as the paint cartridge is loaded on the cartridge mount portion of the housing, the cartridge is located in a predetermined position on the cartridge mount portion by engagement of the positioning coupler portion on the side of the cartridge with the corresponding positioning coupler portion on the side of the housing.

Further, according to the present invention, the housing is provided with a vacuum space which is defined between the cartridge mount portion and the cylinder of the cartridge when the cylinder is mounted in position on the cartridge mount portion, and an air suction passage opened to the vacuum space to suck air out of the vacuum space, to holding the cartridge fixedly against the cartridge mount portion of the housing with suction force.

With the arrangements just described, upon loading the paint cartridge into the cartridge mount portion of the housing, air is sucked through the air suction passage to develop vacuum in a vacuum space which is formed between the cartridge mount portion of the housing and the cylinder of the paint cartridge, thereby holding the cartridge fixedly against the cartridge mounting portion. Upon supplying air to the vacuum space, the paint cartridge is released from the suction force and can be dismantled or unloaded from the housing.

According to the present invention, there may be provided another feed tube passage hole on the housing in coaxial relation with the above-mentioned feed tube in the rotational shaft.

Further, in a particular form of the present invention, an extruding liquid valve is provided in the extruding liquid passage on the side of the housing, and the extruding liquid passage on the side of the cartridge is provided with a valved quick coupling in an open terminal end portion thereof. The quick coupling is opened only when the paint cartridge is fully and fixedly coupled with the cartridge mount portion of the housing.

With the arrangements just described, as soon as the paint cartridge is loaded and fixed in position on the cartridge mounting portion, the quick coupling in the extruding liquid passage on the side of the cartridge is opened, thereby supplying the extruding liquid to the extruding liquid passage in the cartridge through the extruding liquid passage on the side of the housing. On the other hand, as soon as the paint cartridge is dismantled or unloaded from the cartridge mount portion of the housing, the quick coupling is shut off to close the outer open end of the extruding liquid passage on the side of the cartridge, thereby preventing the paint from dripping down therefrom.

Further, in another particular form of the present invention, the extruding liquid valve is provided in the extruding liquid passage on the side of said cartridge, and the extruding liquid passage on the side of the housing is provided with a valved quick coupling in an open terminal end portion thereof, the quick coupling being opened only when the paint cartridge is fully and fixedly coupled with the cartridge mount portion of the housing.

With the arrangements just described, similarly, as soon as the paint cartridge is loaded and fixed in position on the cartridge mounting portion, the quick coupling in the extruding liquid passage on the side of the housing is opened, thereby supplying the extruding liquid to the extruding liquid passage in the cartridge from the extruding liquid passage on the housing. On the other hand, as soon as the paint cartridge is dismantled or unloaded from the cartridge mount portion of the housing, the quick coupling is shut off to close the terminal open end of the extruding liquid passage on the side of the cartridge, thereby preventing the paint from dripping down therefrom.

DETAILED DESCRIPTION OF THE PREFERRED EMBODIMENTS

Figure 1:
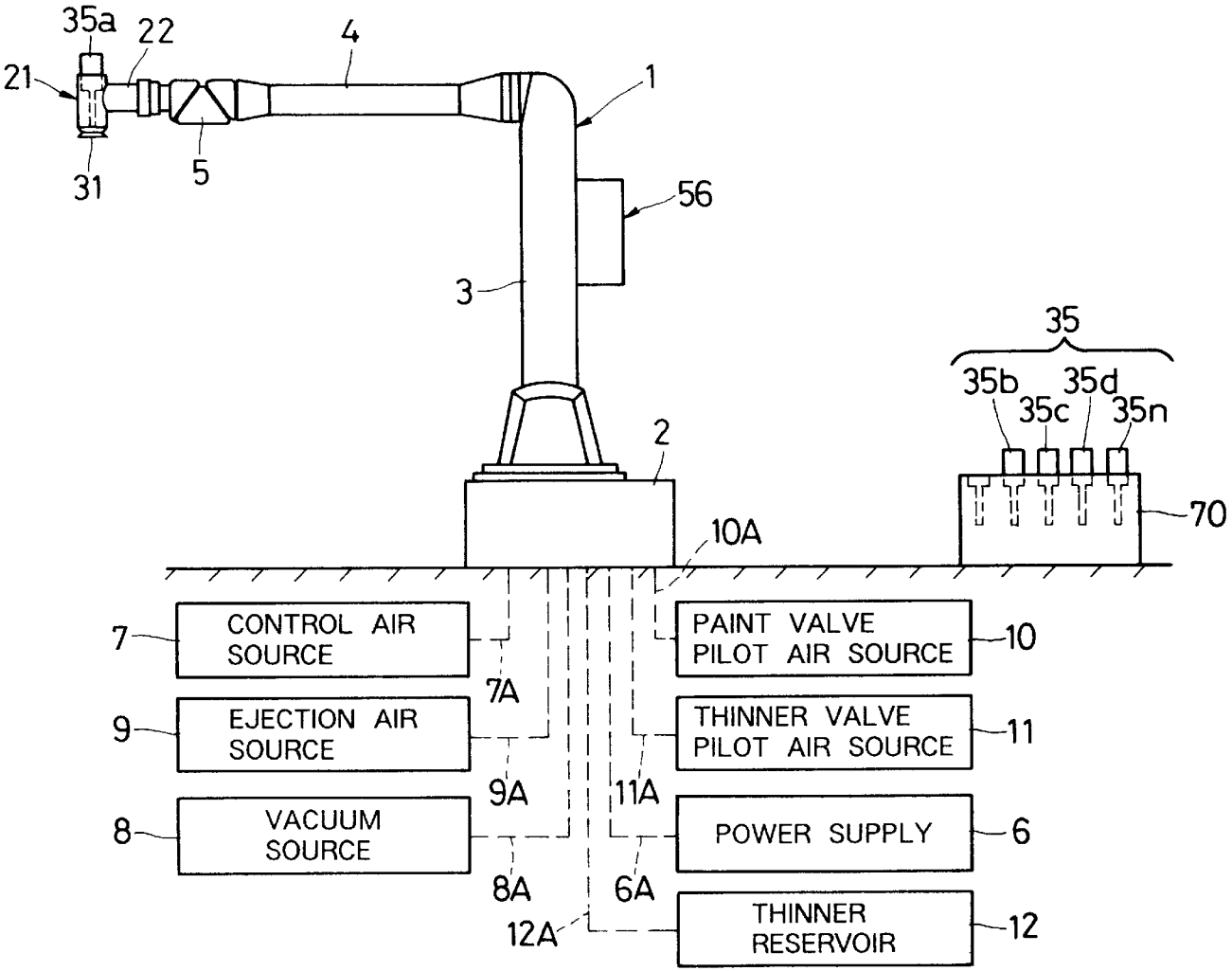
FIG. 1 is a front view of a rotary atomizing head type coating system, adopted as a first embodiment of the present invention and shown together with a coating robot.

Hereafter, with reference to the accompanying drawings, the present invention is described more particularly by way of its preferred embodiments of the rotary atomizing head type coating system, mounted on a coating robot.

Referring first to FIGS. 1 through 11 which show a first embodiment of the present invention, indicated at 1 is a coating robot serving as a working mechanism. The coating robot 1 is largely constituted by a pedestal or base 2, a vertical arm 3 which is rotatably and rockably mounted on the base 1, a horizontal arm 4 which is pivotally connected to the fore distal end of the vertical arm 3, and a wrist portion 5 which is provided at the fore distal end of the horizontal arm 4.

Further, connected to the coating robot 1 are various operating power and fluid sources, including a power supply 6 which is connected through a power supply line 6A, a control air source 7 which is connected through an air hose 7A, a vacuum source 8 which is connected as a vacuum generating means for a vacuum pump, ejector or the like through a vacuum hose 8A, an ejection air source 9 which is connected through an air hose 9A, a paint valve pilot air source 10 which is connected through an air hose 10A, a thinner valve pilot air source 11 which is connected through an air hose 11A, and a thinner reservoir 12 which is connected through a thinner hose 12A to serve as an extruding liquid source. The power supply line 6A and the hoses 7A, 8A, 9A, 10A and 11A are extended as far as the wrist 5 through the vertical and horizontal arms 3 and 4, and connected to the rotary atomizing head type coating system 21 which will be described hereinlater. The thinner hose 12A is passed through the vertical arm 3 and connected to a thinner feeding device 56 as will be described hereinafter.

Figure 2:
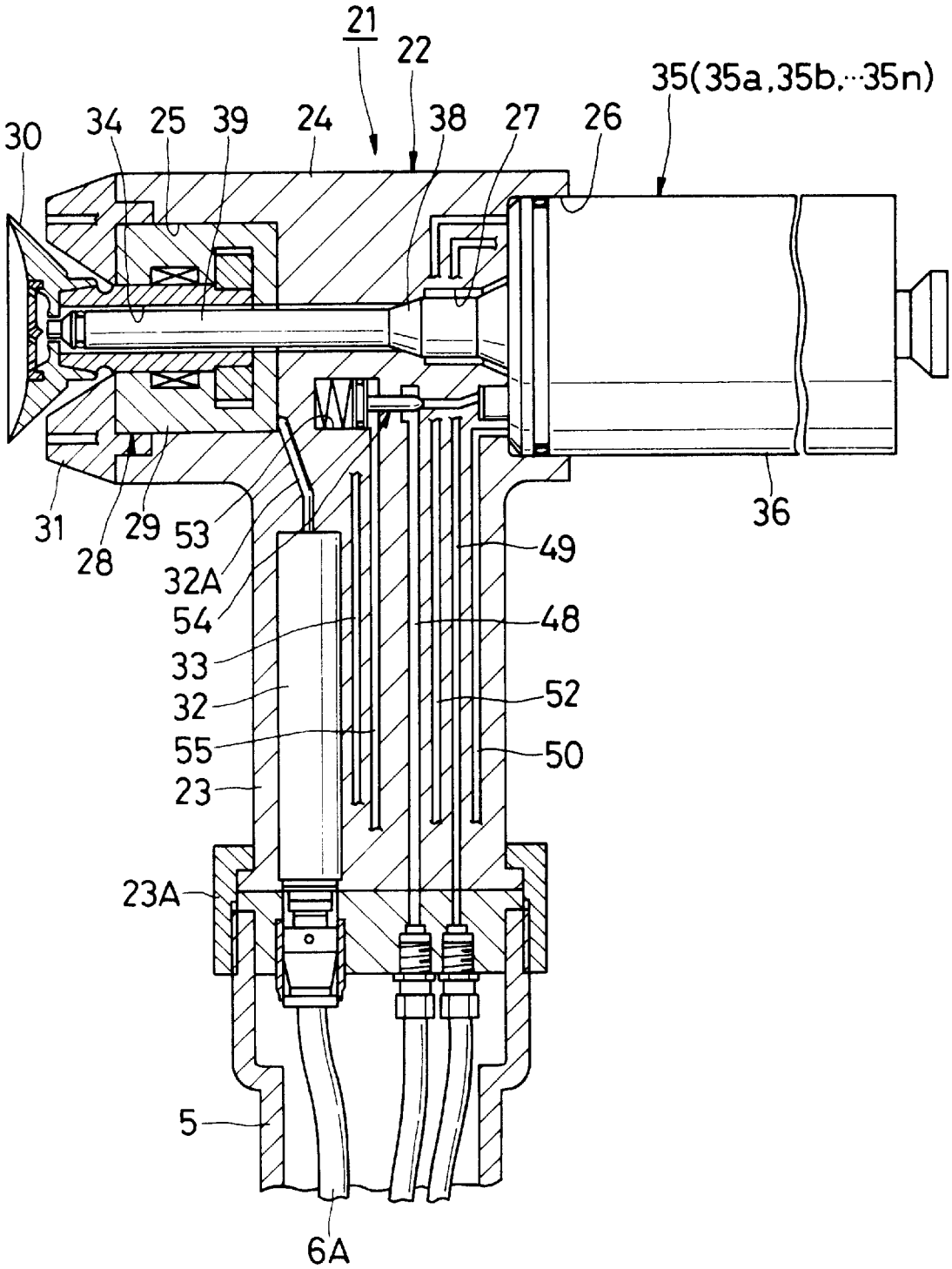
FIG. 2 is a vertical sectional view of the rotary atomizing head type coating system of the first embodiment.
Figure 3:
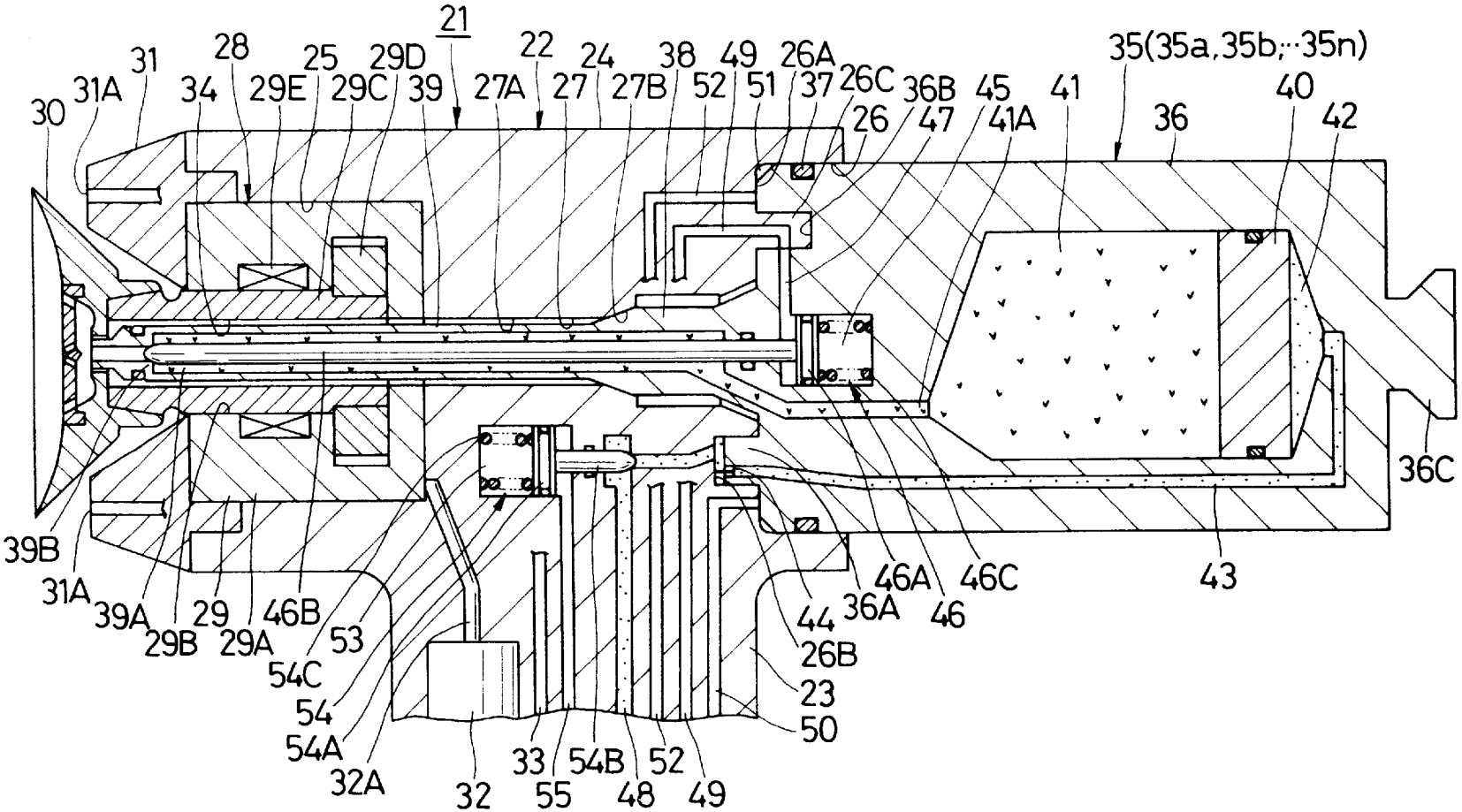
FIG. 3 is a vertical sectional view on an enlarged scale of the rotary atomizing head type coating system shown in FIG. 2.

Indicated at 21 is the rotary atomizing head type coating system (hereinafter referred to simply as "coating system" for brevity) which is mounted on the coating robot 1. As seen in FIGS. 2 and 3, the coating system 21 is largely constituted by a housing 22, a coating machine 28, feed tube passage holes 27 and 34, a paint cartridge 35, a piston 40, thinner passages 43 and 48, a paint valve 46 and a thinner valve 54.

The housing 22 is formed of an engineering plastic, for example, such as PTFE, PEEK, PEI, POM, PI, PET or the like, and attached to the fore distal end of the wrist 5. The housing 22 is constituted by a neck portion 23 to be detachably fixed to the wrist 5 of the coating robot 1 through a clamp member 23A, and a head portion 24 which is formed at and with the fore distal end of the neck portion 23.

In this instance, a coating machine mount portion 25 and a cartridge mount portion 26, both of a hollow cylindrical shape, are formed on the front and rear sides of the head portion 24, respectively. Further, a female connector portion 26B and a male connector portion 26C are formed separately in a bottom portion 26A of the cartridge mount portion 26. The female connector portion 26B is coupled with a male connector portion 36A of a cartridge cylinder 36, which will be described hereinafter, while the male connector portion 26C is coupled with a female connector portion 36B of the cartridge cylinder 36. The female and male connector portions 26B and 26C of the cartridge mount portion 26 function as positioning coupler portions which determine the position of the cylinder 36 in the circumferential direction when connected and coupled therewith.

Denoted at 27 is the feed tube passage hole on the side of the housing, which is provided to extend between and in communication with the coating machine mount portion 25 and the cartridge mount portion 26 of the housing. The feed tube passage hole 27 includes a feed tube passage portion 27A of a small diameter which is located on the front side, and a tapered conical recess 27B which is located on the rear side. In this instance, the feed tube passage portion 27A is formed in coaxial relation with a feed tube passage on the side of the coating machine, which will be described hereinafter. The conical recess 27B functions as a positioning coupler section to hold the paint cartridge 35 in position in axial and radial directions by fitting engagement with a conical recess 38 on the cartridge 35 as will be described hereinafter.

Indicated at 28 is the coating machine which is fitted in the coating machine mount portion 25 of the head portion 24. The coating machine 28 is largely constituted by an air motor 29, a rotary atomizing head 30 to be put in rotation by the air motor 29, and a shaping air ring 31 which is provided on the front side of the air motor 29.

In this instance, the air motor 29 is constituted by a motor case 29A to be fitted into the coating machine mount portion 25, a stepped axial bore 29B which is formed axially through the motor case 29A and varied stepwise in diameter in the axial direction to provide a front large diameter portion and a rear small diameter portion, a rotational shaft 29C which is extended axially through the large diameter portion of the axial bore 29B and projected forward of the motor case 29A at its fore end, an air turbine 29D which is securely fixed to the rear end of the rotational shaft 29C, and a static-pressure air bearing 29E which is provided in the motor case 29A and located around the large diameter portion of the axial bore 29B in small gap relation with the rotational shaft 29C.

Designated at 30 is the rotary atomizing head which is mounted on the air motor 29 at a fore distal end portion of the rotational shaft 29C. The rotary atomizing head 30 is rotated by the air motor 29. When the rotary atomizing head 30 is put in high speed rotation, paint is sprayed from the rotary atomizing head 30 in the form of finely atomized particles, and, as will be described hereinafter, paint particles which are charged with a high voltage are urged to fly toward and deposit on a coating object, traveling along an electrostatic field which is formed between the coating machine and the coating object.

Indicated at 31 is the shaping air ring which is attached to the coating machine mount portion 25 of the head portion 24 in such a way as to hold the air motor 29 fixedly in position from the front side. The shaping air ring 31 is provided with a large number of shaping air outlet holes 31A annularly on and around the outer peripheral side thereof. Through these shaping air outlet holes 31A, shaping air is spurted out toward paint releasing edges of the rotary atomizing head 30 for shaping charged paint particles into a predetermined spray pattern as soon as they are released from the rotary atomizing head 30.

Denoted at 32 is a high voltage generator which is provided in the neck portion 23 of the housing 22. This high voltage generator 32 is constituted, for example, by a Cockcroft circuit which is arranged to elevate a source voltage, which is supplied from the power supply 6 through the power cable 6A, to a level between −60 kV and −120 kV. Through a high voltage cable 32A, for example, the output side of the high voltage generator 32 is electrically connected to the air motor 29, so that a high voltage is applied to the rotary atomizing head 30 from the high voltage generator 32 through the rotational shaft 29C of the air motor 29 for charging the paint directly. Alternatively, in a case where sprayed paint particles are to be charged indirectly by means of an external charging system, the output voltage of the high voltage generator 32 is directly supplied to an external electrode which is provided on or in the vicinity of the shaping air ring 31.

Indicated at 33 are a plural number of air passages which are provided in the neck portion 23 of the housing 22, and which are connected to the control air source 7 through the air hose 7A. These air passages 33 supply turbine air, bearing air, brake air and shaping air. In this particular embodiment, one air passage alone is shown to represent a plural number of air passages.

In this instance, a turbine air passage supplies air to the air turbine 29D of the air motor 29. A bearing air passage supplies air to the static-pressure air bearing 29E of the air motor 29. A brake air passage supplies braking air to the air turbine 29D to brake its rotation. Further, a shaping air passage supplies air toward the shaping air outlet holes 31A of the shaping air ring 31.

Denoted at 34 is a feed tube passage hole on the side of the coating machine, which is extended axially through the rotational shaft 29C and motor case 29A of the air motor 29. The feed tube passage hole 34 on the side of the coating machine is opened at its rear or base end into a feed tube passage portion 27A of the feed tube passage hole 27 on the side of the housing, and at its front end into the rotary atomizing head 30. Further, the feed tube passage hole 34 on the side of the coating machine is formed coaxially aligned relation with the feed tube passage portion 27A of the feed tube passage hole 27 on the side of the housing. A feed tube 39 of a paint cartridge 35 is extractably fitted in these feed tube passage holes 27 and 34.

Figure 4:
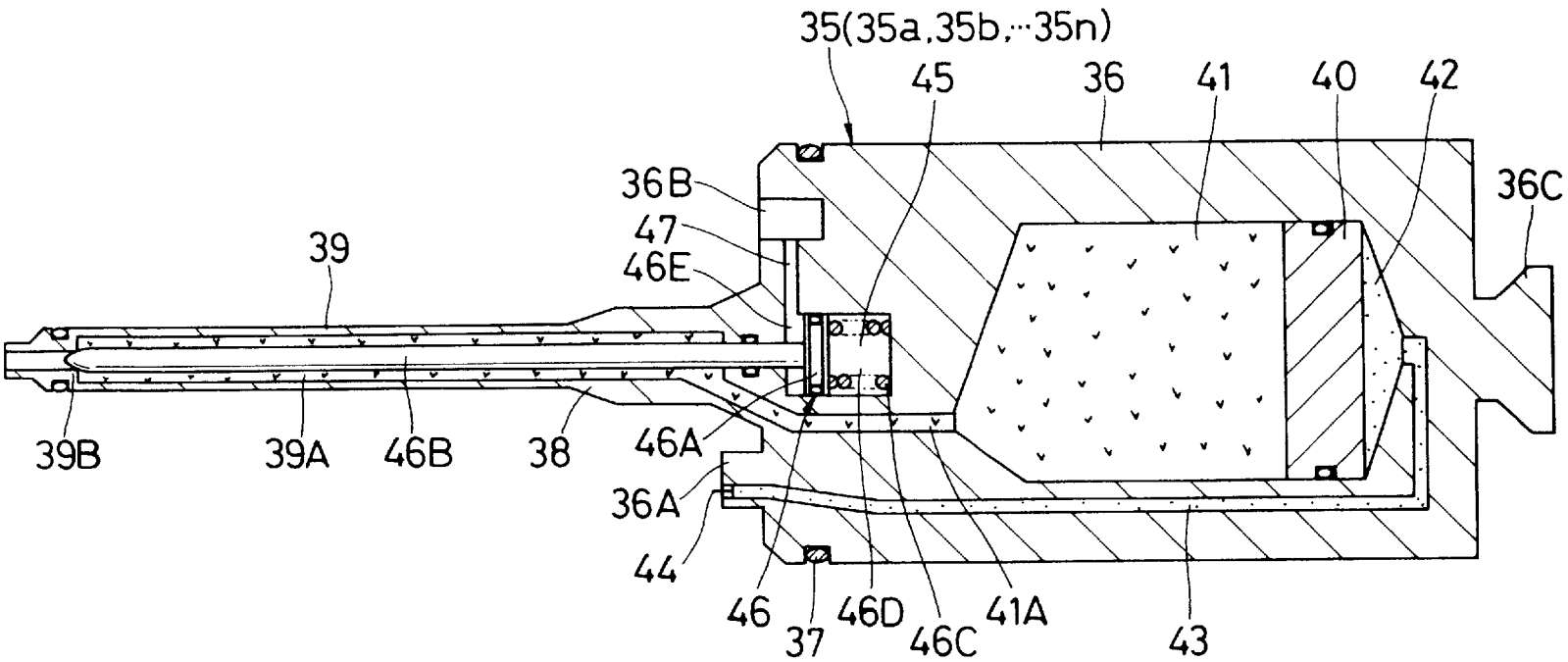
FIG. 4 is a vertical sectional view of a paint cartridge.

Indicated at 35*a*, 35*b* . . . 35*n* are paint cartridges of color a, color b and color n (hereinafter referred to collectively as "paint cartridges 35" for the convenience of explanation), respectively, which hold different paint colors separately and independently for supply to the rotary atomizing head 30. Each one of these paint cartridges 35 is arranged to be inserted into the feed tube passage holes 27 and 34 to supply paint of a particular color independently to the rotary atomizing head 30. As shown in FIG. 4, the cartridges 35 are largely constituted by a cylinder 36, a conical nose-like projection 38 which is provided on the front end face of the cartridge cylinder 36, a feed tube 39 which is extended axially forward from the conical projection 38 to provide therein a paint passage 39A leading from the cartridge cylinder 36, a piston 40 which is fitted in the cartridge cylinder 36 as a movable partition wall, and a thinner passage 43 which is provided on the side of the paint cartridge to supply thinner as a paint extruding liquid.

The cartridge cylinder 36, a main body of the paint cartridge 35, is formed of an engineering plastic similarly to the housing 22 and in the shape of a cylinder of a suitable diameter which can be detachably fitted in the cartridge mount portion 26 of the housing. An O-ring 37 is fitted in a fore position on the outer periphery of the cartridge cylinder 36 to hermetically seal the gap space between the cylinder 36 and the cartridge mount portion 26. Further, a male connector portion 36A and a female connector portion 36B are provided at the fore end of the cylinder 36 in confronting positions relative to the female and male connector portion 26B and 26C on the part of the cartridge mount portion 26, respectively. In addition, the cylinder 36 is provided with a grip portion 36C at its rear end, which is gripped by an operator when mounting or dismantling the paint cartridge 35. The male and female connector portions 36A and 36B also function as positioning coupler portions which determine the position in the circumferential direction of the cartridge cylinder 36 on the cartridge mount portion 26.

Indicated at 38 is a conical coupling projection which is formed integrally with the cartridge cylinder 36. When the cartridge 35 is mounted on the cartridge mount portion 26 of the housing 22, the conical projection 38 is coupled with the conical coupling recess 27B to determine the position of the paint cartridge 35 in both axial and radial directions.

Indicated at 39 is a feed tube which is provided at a fare end of the concial coupling projection 38. A feed tube 39 is formed coaxially a paint supply passage 39A. The base or rear end of the paint supply passage 39A is connected to a paint reservoir chamber 41 which will be described hereinafter, while its fore end is opened toward the rotary atomizing head 30. The feed tube 39 is provided with a valve seat portion 39B which is formed by reducing the diameter of a fore end portion of the paint supply passage 39A. A valve body 46B of a paint valve 46, which will be described hereinafter, is seated on and off the valve seat portion 39B. The feed tube 39 has such a length that its fore distal end is extended into the rotary atomizing had 30 when the cartridge 35 is loaded in position on the cartridge mount portion 26 of the housing 22.

On the other hand, a piston 40 is fitted in the cylinder 36 for sliding movements in the axial direction. By the piston 40, the cartridge cylinder 36 is partitioned into a paint reservoir chamber 41, which is communicated with the paint supply passage 39A of the feed tube 39 through a communication passage 41A, and a thinner chamber 42 as a paint-extruding liquid chamber which holds thinner as a paint-extruding liquid.

Indicated at 43 is a thinner passage which is formed on the side of the cartridge as a passage for an extruding liquid. The thinner passage 43 on the side of the cartridge is formed axially in and along the outer periphery of the cylinder 36. One end of the thinner passage 43 is opened in the fore end face of the male connector portion 36A of the cylinder 36, while the other end is communicated with the thinner chamber 42. Through the thinner passage 43 on the side of the cartridge, thinner is supplied to the thinner chamber 42 to push the piston 40 forward or toward the feed tube 39. By this movement of the piston 40, the paint which is filled in the paint reservoir chamber 41 is extruded toward the rotary atomizing head 30.

The thinner which is used as a paint-extruding liquid is selected from a electrically insulating type or from a high resistance type in order to prevent leaks through the thinner of the high voltage which is applied by the high voltage generator 32. As an extruding liquid, the thinner contributes to keep the inner wall surfaces of the cylinder 36 constantly in a wet state, preventing the paint from getting dry and sticking thereto when the piston 40 is displaced therein. Consequently, thanks to stabilization of the frictional resistance in the sliding contact between the piston 40 and the cylinder 36, the piston 40 can be moved very smoothly. In addition, the hermetical seal between the piston 40 and the cylinder 36 can be improved in tightness.

Figure 6:
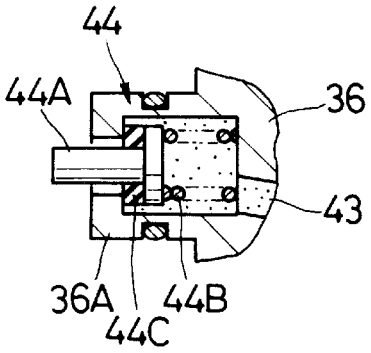
FIG. 6 is a vertical sectional view on an enlarged scale of a valved quick coupling shown in FIG. 5.

Indicated at 44 is a valved quick coupling which is provided at the open end of the thinner passage 43 in the male connector portion 36A on the paint cartridge 36. The valved quick coupling 44 is arranged as a check valve including the afore-mentioned male connector portion 36A of the cylinder 36. As shown in FIG. 6, the quick coupling 44 is largely constituted by the male connector portion 36A, a valve body 44A of a stepped cylindrical shape which has a fore end portion projected on the front side of the male connector portion 36A, a coil spring 44B biasing the valve body 44A in the projecting direction, and a resilient ring 44C of rubber or the like which is provided on the outer periphery of the valve body 44A to seal the gap space between the valve body 44A and the male connector portion 36A.

Figure 5:
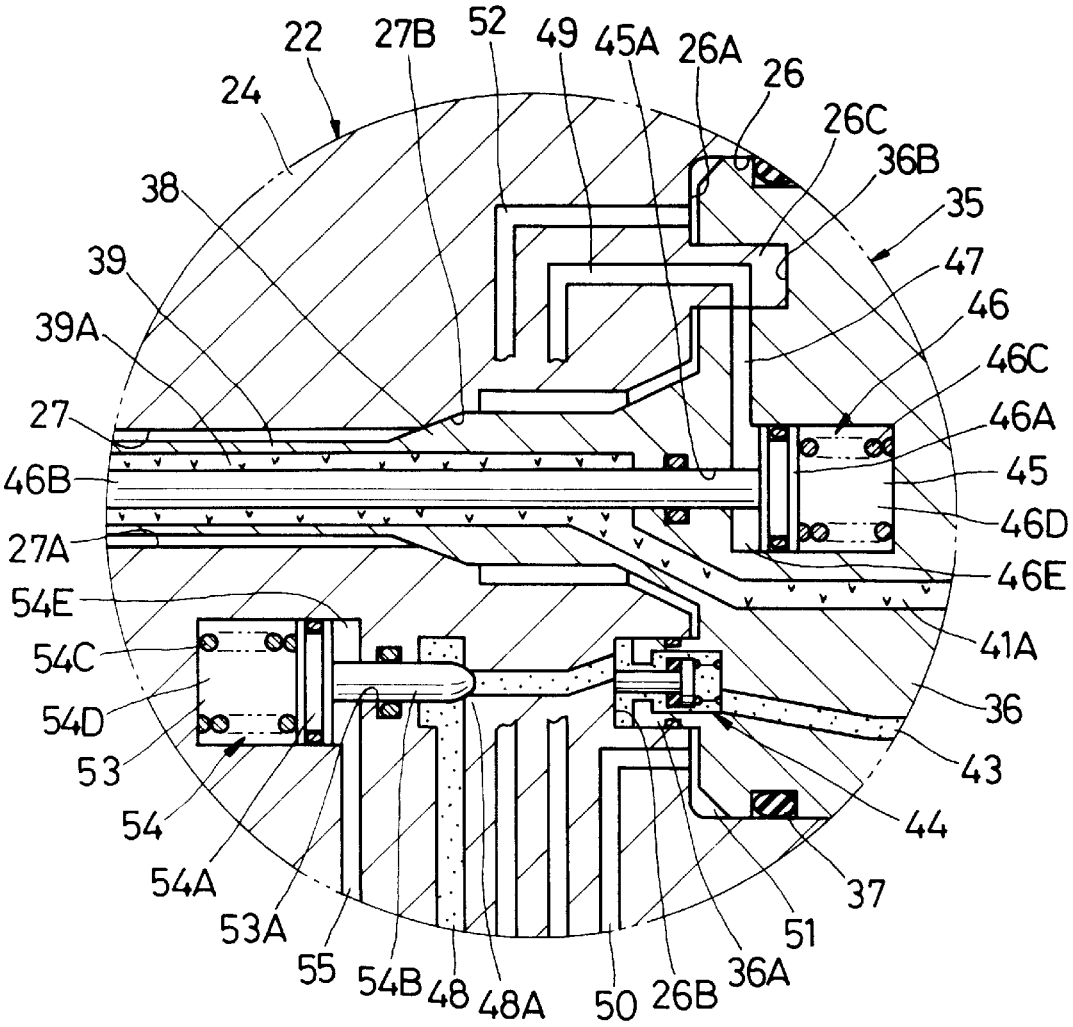
FIG. 5 is a vertical sectional view on an enlarged scale of a paint valve and a thinner valve in FIG. 3.

The quick coupling 44 is opened to communicate the thinner passage 43 on the side of the cartridge with a thinner passage 48 on the side of the housing, which will be described hereinafter, to permit circulation of the thinner only when the cartridge 35 is attached to the cartridge mount portion 26 and the male connector portion 36A is coupled with the female connector portion 26B until the fore end of the valve body 44A of the quick coupling 44 is abutted against the bottom of the female connector portion 26B as shown in FIG. 5.

Figure 7:
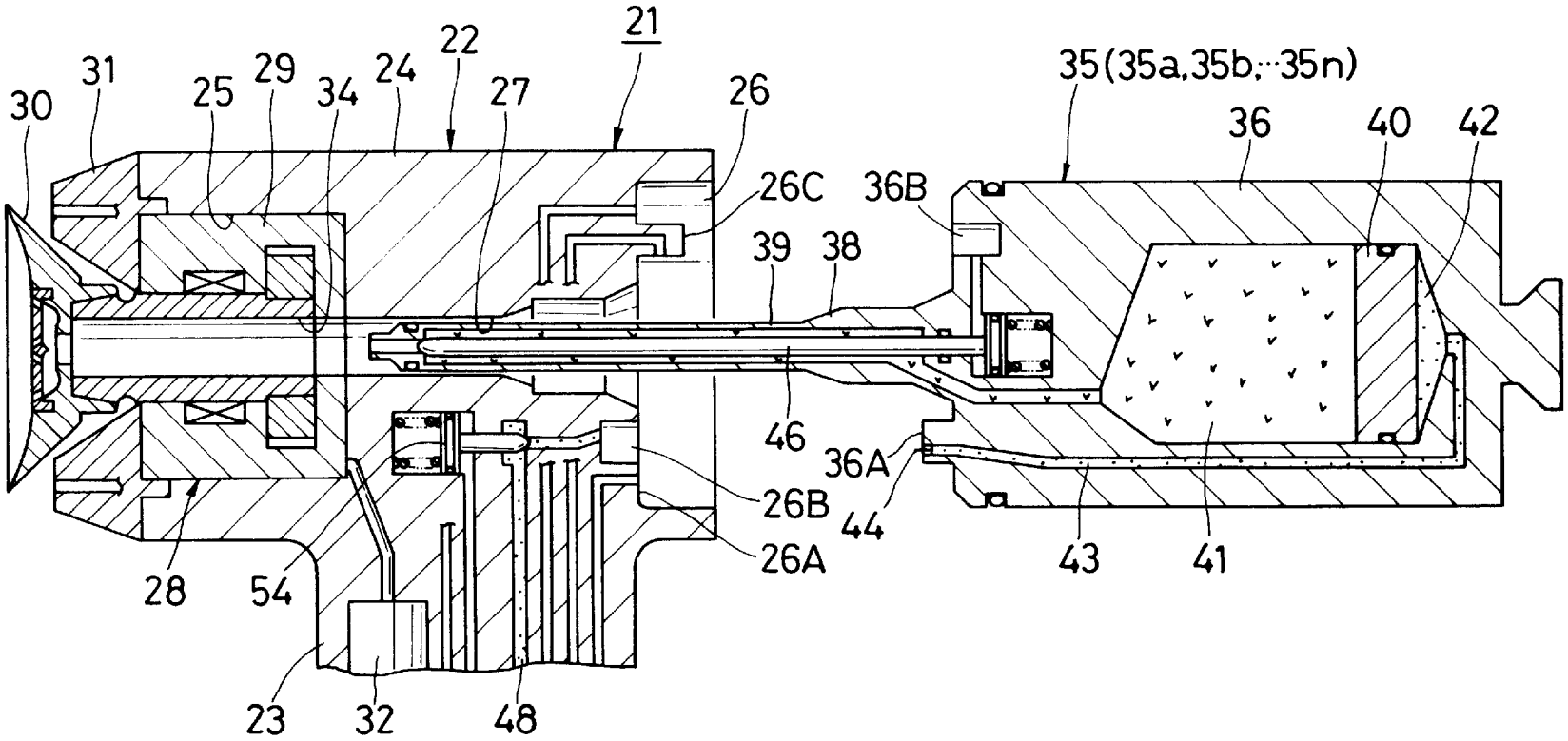
FIG. 7 is a vertical sectional view of a paint cartridge removed from a housing.

On the other hand, when the cartridge 35 is dismantled from the cartridge mount portion 26, disengaging the male connector portion 36A from the female connector portion 26B as shown in FIG. 7, the valve body is pushed against the valve seat by the coil spring 44B along with the resilient ring 44C to close the thinner passage 43 on the side of the cartridge, thereby preventing thinner from flowing out of the thinner passage 43.

Indicated at 45 is a paint valve receptacle portion which is provided at the front end of the cartridge cylinder 36, the paint valve receptacle portion 45 being in the form of a round bore which is located in coaxial relation with the feed tube 39. A valve receiving bore 45A is provided axially in the paint valve receptacle portion 45 in communication with the paint supply passage 39. As described below, a paint valve 46 is accommodated in the paint valve receptacle portion 45.

The paint valve 46, which is provided on the cartridge 35, is opened when the paint in the paint reservoir chamber 41 is to be fed to the rotary atomizing head 30. The paint valve 46 is constituted by a piston 46A which is slidably fitted in the paint valve receptacle portion 45, an elongated valve body 46B which is attached to the piston 46A at its base end and extended through the paint supply passage 39A of the feed tube 39 through the valve receiving bore 45A to seat on and off a valve seat 39B at its fore end, and a valve spring 46C biasing the valve body 46B in the seating direction through the piston 46A. Further, by the piston 46A, the paint valve receptacle portion 45 is divided into a spring chamber 46D, which accommodates the above-described valve spring 46C, and a pressure receiving chamber 46E to which pilot air is introduced. Thus, the paint valve 46 is constituted as an air pilot operated control valve.

Normally, the valve body 46B of the paint valve 46 is seated on the valve seat 39B of the feed tube 39 under the influence of the biasing action of the valve spring 46C, shutting off the paint supply passage 39A to stop the paint supply to the rotary atomizing head 30. On the other hand, when pilot air is supplied to the pressure receiving chamber 46E from a paint valve pilot air source 10 through the air hose 10A, the pilot air passage 49 on the side of the housing and the pilot air passage 47 on the side of the cartridge, the valve body 46B of the paint valve 46 is unseated from the valve seat 39B against the action of the valve spring 46C to supply paint in the paint reservoir chamber 41 to the rotary atomizing head 30. In this instance, one end of the pilot air passage 47 is opened to the inner periphery of the female connector portion 36B of the cylinder 36, while the other end of the pilot air passage is communicated with the pressure receiving chamber 46E of the paint valve 46.

Indicated at 48 is a thinner passage which is provided on the side of the housing 22 as an extruding liquid passage. As shown in FIG. 5, the thinner passage 48 is extended axially through the neck portion 23 and bent rearward in the shape of letter L at the position of a valve receiving bore 53A of a thinner valve receiving portion 53. This thinner passage 48 on the side of the housing has one end connected to a thinner feeding device 56, which will be described hereinafter, and has the other end opened in a bottom portion of the female connector portion 26B of the cartridge mount portion 26. Besides, the bent portion of the thinner passage 48 on the side of the housing forms a valve seat 48A on which a valve member 54B of a thinner valve is to be seated on and off.

Designated at 49 is a pilot air passage which is provided on the side of the housing 22. One end of this pilot air passage 49 is connected to the paint valve pilot air source 10 through the air hose 10A. The other end of the pilot air passage 49 is opened on the circumferential surface of the male connector portion 26C which is provided on the bottom portion 26A of the cartridge mount portion 26 at a position where it meets the pilot air passage 47 on the side of the paint cartridge.

Indicated at 50 is an air suction passage which is provided on the housing 22 and opened to the bottom portion 26A of the cartridge mount portion 26. This air suction passage 50 is connected to a vacuum source 8 through a vacuum hose 8A. The paint cartridge 35 is drawn to and fixed against the cartridge mount portion 26 by the vacuum force of the air suction passage which sucks air in a vacuum space 51 (FIG. 5) which is defined between the deepest portion of the cartridge mount portion 26 and the cylinder 36 of the cartridge 35.

Further, indicated at 52 is an ejection air passage which is provided on the housing 22 and opened in the bottom portion 26A of the cartridge mount portion 26. This ejection air passage 52 is connected to the ejection air source 9 through the air hose 9A. By supplying air to the vacuum space 51, the ejection air passage 52 releases the cartridge 35 from cartridge mount portion 26 by canceling the vacuum grip, thereby permitting to dismantle the paint cartridge 35 from the housing.

Denoted at 53 is a thinner valve receptacle portion which is provided in the head portion 24 of the housing 22. As shown in FIG. 5, this thinner valve receptacle portion 53 is in the form of a round bore which is located in a deep position axially spaced from the female connector portion 26B. Further, provided between the thinner valve receptacle portion 53 and the female connector portion 26B is a thinner valve receiving bore 53A which is extended to as far as a point which meets the thinner passage 48 on the side of the housing 22. As described below, a thinner valve 54 is accommodated in the thinner valve receptacle portion 53.

The thinner valve 54 is provided within the length of the thinner passage 48 on the side of the housing 22 to serve as an extruding fluid valve. This thinner valve 54 is opened to supply thinner to the thinner chamber 42 at the time of feeding paint in the paint reservoir chamber 41 to the rotary atomizing head 30.

Similarly to the above-described paint valve 46, the thinner valve 54 is constituted by a piston 54A which is slidably received in the thinner valve receptacle portion 53, a valve body 54B which is connected to the piston 54A at its base end and projected into the thinner passage 48 through the valve receiving bore 53A to seat on and off a valve seat 48A at its fore end, and a valve spring 54C which constantly biases the valve body 54B in the seating direction through the piston 54A. Further, by the piston 54A, the thinner valve receptacle portion 53 is divided into a spring chamber 54D which accommodates the above-mentioned valve spring 54C, and a pressure receiving chamber 54E into which pilot air is introduced. Thus, the thinner valve 54 is constructed as an air pilot operated control valve.

Normally, under the influence of the biasing action of the valve spring 54C, the valve body 54B of the thinner valve 54 is seated on the valve seat 48A of the thinner passage 48, thereby shutting off the thinner passage 48 to stop thinner supply to the thinner chamber 42. On the other hand, when pilot air is supplied to the pressure receiving chamber 54E from the thinner valve pilot air source 11 through the air hose 11A and pilot air passage 55, the valve body 54B is unseated from the valve seat 48A against the action of the valve spring 54C to permit thinner supply to the thinner chamber 42. In this instance, one end of the pilot air passage 55 is connected to the thinner valve pilot air source 11 through the air hose 11A, while the other end is communicated with the pressure chamber 54E of the thinner valve 54.

The opening and closing actions of the paint valve 46 and of the thinner valve 54 are controlled to take place synchronously with start and stop of a servo motor 63 which will be described hereinafter. Therefore, upon stopping a coating operation, paint is prevented from flowing out from the paint supply passage 39A of the feed tube 39 and the paint reservoir chamber 41 by the residual thinner pressures in the thinner chamber 42 and in the thinner passage 43 on the side of the cartridge.

Figure 8:
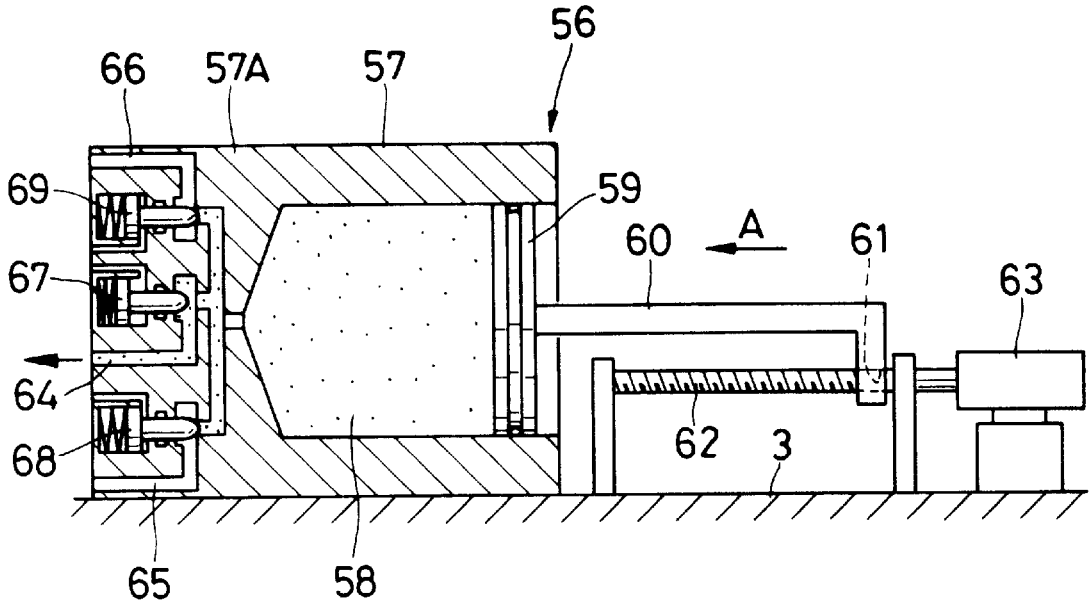
FIG. 8 is a vertical sectional view of a thinner feeding means employed in the first embodiment.
Figure 9:
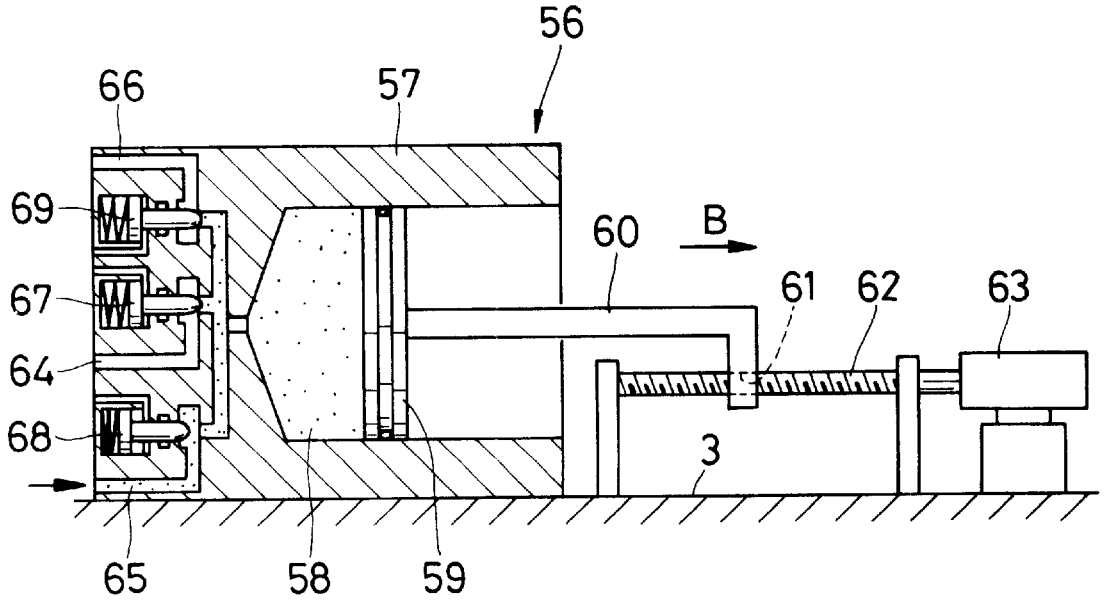
FIG. 9 is a vertical sectional view of the thinner feeding means in a thinner replenishing phase.
Figure 10:
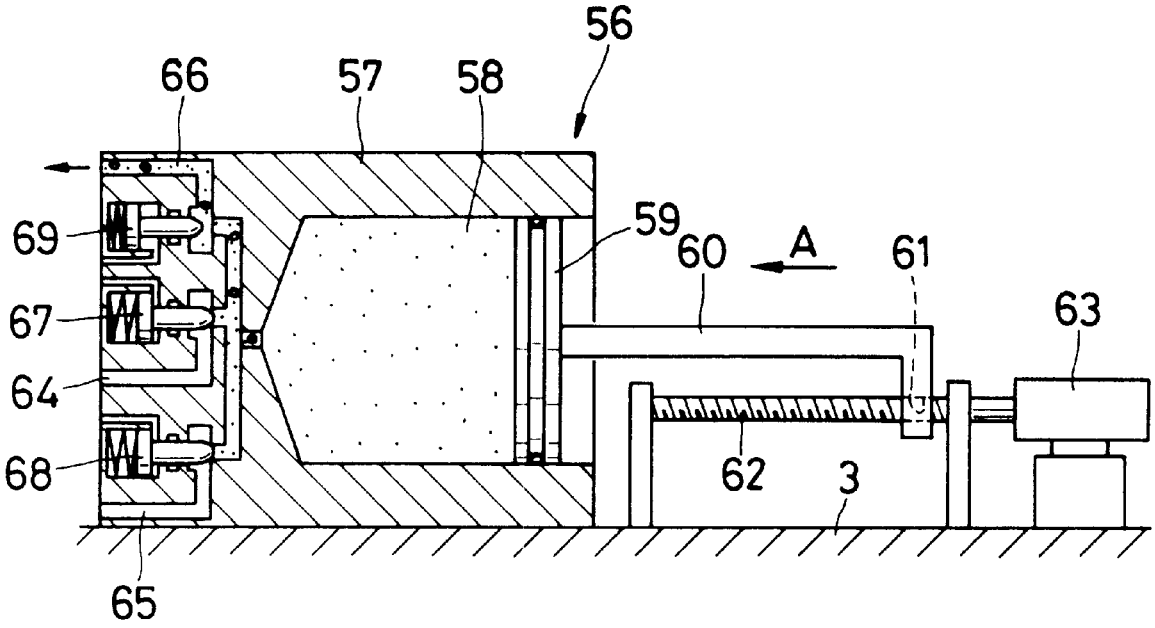
FIG. 10 is a vertical sectional view of the thinner feeding means in an air bubble stripping phase.

Denoted at 56 is a thinner feeding device which serves as an extruding liquid feeding means. As shown in FIG. 1, this thinner feeding device 56 is mounted on the vertical arm 3 of the coating robot 1. Further, as shown in FIGS. 8 to 10, the thinner feeding device 56 is constructed as a positive displacement pump, including a bottomed cylinder 57 which has a bottom portion 57A located on the front side, a piston 59 which is slidably received in the cylinder 57 in such a way as to define a thinner feeding chamber 58, a piston rod 60 which is axially extended from the piston 59 and provided with a downwardly bent portion at its fore end, a female screw 61 which is formed at the fore end of the piston rod 60, a male screw 62 which is extended parallel with the piston rod 60 and engaged with the female screw 61 through a large number of steel balls (not shown), forming a ball screw together with the female screw 61, and a servo motor 63 which is connected to the male screw 62. In this instance, the servo motor 63 is controlled to start and stop in synchronism with opening and closing actions of the paint valve 46 and of the thinner valve 54.

Further, provided in the bottom portion 57A of the cylinder 57 are a thinner supply passage 64 which is connected to the thinner passage 48 on the side of the housing through a thinner hose (not shown), a thinner replenishing passage 65 which is connected to the thinner reservoir or thinner source 12 through the thinner hose 12A to serve as an extruding liquid replenishing conduit, and a drain passage or conduit 66 which is connected to the drain side. These thinner supply passage 64, thinner replenishing passage 65 and drain passage 66 are respectively communicated with the thinner feeding chamber 58.

Indicated at 67 is a thinner supply valve which is provided in the thinner supply passage 64 in the bottom portion 57A of the cylinder to serve as an extruding liquid supply valve. This thinner supply valve 67 is normally closed to shut off the thinner supply passage 64, and opened to put the thinner supply passage 64 in communication only when pilot air is supplied thereto.

Denoted at 68 is a thinner replenishing valve which is provided in the thinner replenishing passage 65 in the bottom portion 57A of the cylinder 57 to serve as an extruding liquid replenishing valve. This thinner replenishing valve 68 is normally closed to shut off the thinner replenishing passage 65, and opened to put the thinner replenishing passage 65 in communication only when pilot air is supplied thereto.

Indicated at 69 is a bubble extraction valve which is provided in the drain passage 66 in the bottom portion 57A of the cylinder 57. This bubble extraction valve 69 is normally closed to shut off the drain passage 66, and opened to put the drain passage 66 in communication only when pilot air is supplied thereto.

With the thinner feeding device 56 which is arranged as described above, when the servo motor 63 is rotated in the forward direction to turn the male screw 62 relative to the female screw 61, the piston 59 is displaced through the piston rod 60 at a constant speed in the direction of arrow A as shown in FIGS. 6 and 10, thereby causing the thinner in the thinner feeding chamber 58 to flow out either into the thinner supply passage 64 or into the drain passage 66. On the other hand, when the servo motor 63 is rotated in the reverse direction, the piston 59 is displaced in the direction of arrow B as shown particularly in FIG. 9 to suck in thinner through the thinner replenishing passage 65.

In this instance, for the sake of air bubble extraction which will be described hereinafter, the fore end of the cylinder 57, with the bubble extraction valve 69, is located on the top side when mounting the thinner feeding device 56 on the vertical arm 3 of the coating robot 3.

On the other hand, indicated at 70 (in FIG. 1) is a cartridge holder table which is provided in a coating booth and in a position in the vicinity of the coating robot 1. Placed on the cartridge holder table 70 are paint cartridges 35*a*, 35*b* . . . 35*n* of different colors. In addition to the paint cartridges, supported on the cartridge holder table 70 are a number of utility equipments (not shown), including a paint refilling device to be used at the time of refilling paint into the paint reservoir chamber 41 of the cartridge 35, a thinner collecting device to be used for collecting thinner which is discharged from the thinner chamber 42 at the time of refilling paint, and a cartridge changer to be used at the time of replacing a cartridge 35 on the housing 22. Besides, an atomizing head washing device (not shown) is provided in the vicinity of the cartridge holder table 70 to wash off residues of previous color from the rotary atomizing head 30 when changing the paint color.

The rotary atomizing head type coating system 21 of the present embodiment, with the above-described arrangements, is operated in the manner as described below with reference to the time chart of FIG. 11.

Firstly, upon finishing a coating operation in color a, for example, the paint color is changed from color a to color b in the following manner. In this case, a paint cartridge 35*a* of color a which is now mounted on the housing 22 is replaced by a paint cartridge 35*b* of color b.

At the time of changing the paint color from a to b, while the cartridge 35*a* of color a is on the cartridge mount portion 26 of the housing 22, the paint valve 46 is closed to shut off the paint supply passage 39A of the feed tube 39, and the thinner valve 54 is also shut off to close the thinner passage 48 on the side of the housing. In the meantime, on the side of the thinner feeding device 56, the servo motor 63 is stopped, and the thinner supply valve 67 is closed to shut off the thinner supply passage 64. Moreover, power supply to the high voltage generator 32 from the power source 6 is stopped upon completing a coating operation in color a.

More particularly, the following operations are performed when changing the paint color. Firstly, while the paint cartridge 35*a* of color a is still on the housing 22, the coating machine 28 is moved toward the atomizing head washing device in the vicinity of the cartridge holder table 70 by operating the vertical and horizontal arms 3 and 4 of the coating robot 1.

As soon as the coating machine 28 (rotary atomizing head 30) is located face to face with the atomizing head washing device, wash thinner is spurted against the rotary atomizing head 30 to wash off deposited residues of color a therefrom.

Subsequent to the atomizing head washing or cleaning operation, the paint cartridge is replaced in the manner as follows. For the replacement of the paint cartridge, the air motor 29 is turned off, and the supply of shaping air is stopped. At the same time, air from the vacuum generating source 8 is cut off to cancel the suction force which has been holding the cartridge 35*a* fixedly against the housing 22. Thereafter, air from the ejection air source 9 is supplied to the vacuum space 51 through the air hose 9A and ejection air supply passage 52 to free the paint cartridge 35*a* from the cartridge mount portion 26, and the cartridge 35*a* is extracted axially out of the housing 22 and returned to the cartridge holder table 70.

After unloading or dismantling the paint cartridge 35*a* of color a from the housing 22 in this manner, the paint cartridge 35*b* of color b is picked up from the cartridge holder table 70 and mounted on the housing 22. At this time, while the cylinder 36 is being set in position on the cartridge mount portion 26 of the head portion 24, the feed tube 39 is inserted into the feed tube passage hole 34 on the side of the coating machine through the conical recess 27B of the feed tube passage hole 27 and the feed tube passage portion 27A on the side of the housing 22.

Further, as the cartridge 35*b* is mounted on the cartridge mount portion 26 of the housing 22, the male and female connecting portions 36A and 36B of the cylinder 36 are coupled with the female and male connecting portions 26B and 26C on the cartridge mount portion 26. Therefore, the position of the cylinder 36 in the circumferential direction relative to the cartridge mount portion 26 is determined by coupling engagement of these connecting portions. Besides, at this time, the conical projection 38 which is formed on the side of the cartridge 35*b* is brought into fitting engagement with the conical recess 27B on the housing 22, placing the feed tube 39 in a centered position relative to the feed tube passage hole 27 on the housing and the feed tube passage hole 34 on the coating machine and simultaneously determining its axial position relative to the cartridge mount portion 26.

Further, when the cylinder 36 of the paint cartridge 35*b* is set in position on the cartridge mount portion 26, the valve of the quick coupling 44 is opened to communicate the thinner passage 43 on the side of the cartridge with the thinner passage 48 on the side of the housing.

Then, after insertion of the cartridge 35*b* into the cartridge mount portion 26, air in the vacuum space 51 between the cartridge mount portion 26 and the cylinder 36 is sucked out by the vacuum source 8 through the air suction passage 50. Accordingly, the cartridge 35*b* of color b is securely gripped in position of the housing 22 by vacuum, and thereby preventing from coming off its position in the housing.

As soon as the cartridge 35*b* of color b is fixedly set in position on the housing 22 in this manner, air is supplied from the control air source 7 to drive the air motor 29, putting the rotary atomizing head 30 in rotation and spurting out shaping air through the respective shaping air outlet holes 31A in the shaping air ring 31 to standby for a coating operation.

In the meantime, a thinner replenishing operation for the thinner feeding device 56 is carried out simultaneously with the above-described replacement of the paint cartridge 35*a* and 35*b*.

In the thinner replenishing operation, firstly thinner is sucked into the thinner feeding chamber 58 to compensate for the thinner which had been used in spraying the previous color a. For this purpose, the thinner replenishing valve 68 is opened to connect the thinner feeding chamber 58 in the cylinder 57 with the thinner reservoir 12 through the thinner replenishing passage 65 and thinner hose 12A, followed by reverse rotation of the servo motor 63.

As a consequence, at the thinner feeding device 56, the piston 59 is displaced in the direction of arrow B as shown in FIG. 9 to suck thinner into the thinner feeding chamber 58 from the thinner reservoir or source 12 through the thinner hose 12A and thinner replenishing passage 65.

When thinner is sucked and replenished into the thinner chamber 58 from the thinner reservoir 12 in this way, a slight amount of air is trapped in the form of air bubbles in the thinner flow to the thinner feeding chamber 58. The air bubbles which are contained in thinner are compressed when the thinner is pumped out at the time of a coating operation, and could destabilize the thinner feed rate.

To avoid this, air bubbles in thinner are removed as soon as a predetermined amount of thinner is filled in the thinner feeding chamber 58. More specifically, as shown in FIG. 10, the thinner replenishing valve 68 is closed to shut off the thinner replenishing passage 65, and then the air bubble extraction valve 69 is opened to communicate the thinner feeding chamber 58 with the drain side through the drain passage 66. Then, the servo motor 63 is rotated in the forward direction in this state.

At this time, since the cylinder 57 of the thinner feeding device 56 is mounted on the vertical arm 3 of the coating robot 1 with the air bubble extraction valve 69 on the upper side, air bubbles in the thinner feeding chamber 58 tend to gather within or in the vicinity of the drain passage 66. Therefore, air bubbles can be expelled to the drain side through the drain passage 66 simply by displacing the piston 59 over a small distance in the direction of arrow A by means of the servo motor 63. After removal of air bubbles from thinner, the bubble extraction valve 69 is closed to end the thinner replenishing operation.

Following the above-described cartridge replacement from color a to color b and thinner replenishment to the thinner feeding device 56, the machine is put in an operative state again for a coating operation in color b in the manner as follows.

Firstly, in the case of a coating operation in color b, the paint valve 46 and the thinner valve 54 are opened to put into communication the paint supply passage 39A of the feed tube 39 as well as the thinner passage 48 on the side of the housing. Then, power is supplied from the power source 6 to the high voltage generator 32 through the power line 6A to apply a high voltage to the air motor 29 and rotary atomizing head 30.

In the meantime, at the thinner feeding device 56, the thinner supply valve 67 is opened as shown in FIG. 8 to communicate the thinner feeding chamber 58 with the thinner reservoir chamber 42 of the paint cartridge 35*b* through the thinner supply passage 64, the thinner passage 48 on the side of the housing and the thinner passage 43 on the side of the cartridge. Then, the servo motor 63 is rotated in the forward direction, thereby displacing the piston 59 at a constant speed in the direction of arrow A to supply thinner in the thinner feeding chamber 58 quantitatively to the thinner reservoir chamber 42 of the paint cartridge 35*b* through the thinner passages 48 and 43.

Consequently, the piston 40 of the cartridge 35*b* is displaced at a constant speed toward the feed tube 39 by the thinner which is introduced into the thinner reservoir chamber 42, thereby causing the paint of color b in the paint reservoir chamber 41 to flow out toward the rotary atomizing head 30 through the paint supply passage 39A of the feed tube 39.

Then, the paint of color b which is supplied forward through the paint supply passage 39A of the feed tube 39 gets onto the rotary atomizing head 30 which is put in high speed rotation by the air motor 29, and applied with a high voltage on the rotary atomizing head 30. Therefore, the paint of color b is centrifugally atomized into fine particles by the rotary atomizing head 30, and sprayed in the form charged and finely divided particles. On the other hand, by the action of the shaping air which is spurted out through the respective shaping air outlet holes 31A of the shaping air ring 31, the charged paint particles are shaped into a desired spray pattern, and said particles fly toward a coating object along an electrostatic field which is formed between the coating machine and the coating object to deposit on.

During a coating operation, the coating machine 21 is put in reciprocating movements along surfaces of a coating object. In order to prevent the coating from getting thicker locally at reversing positions of the coating machine 21, it is the general practice to reverse the movement of the coating machine 21 at positions outside a coating surface of work and to stop paint spraying at these reversing positions. Accordingly, the paint spraying by the coating machine 21 is turned on and off repeatedly for coating a single piece of work.

Figure 11:
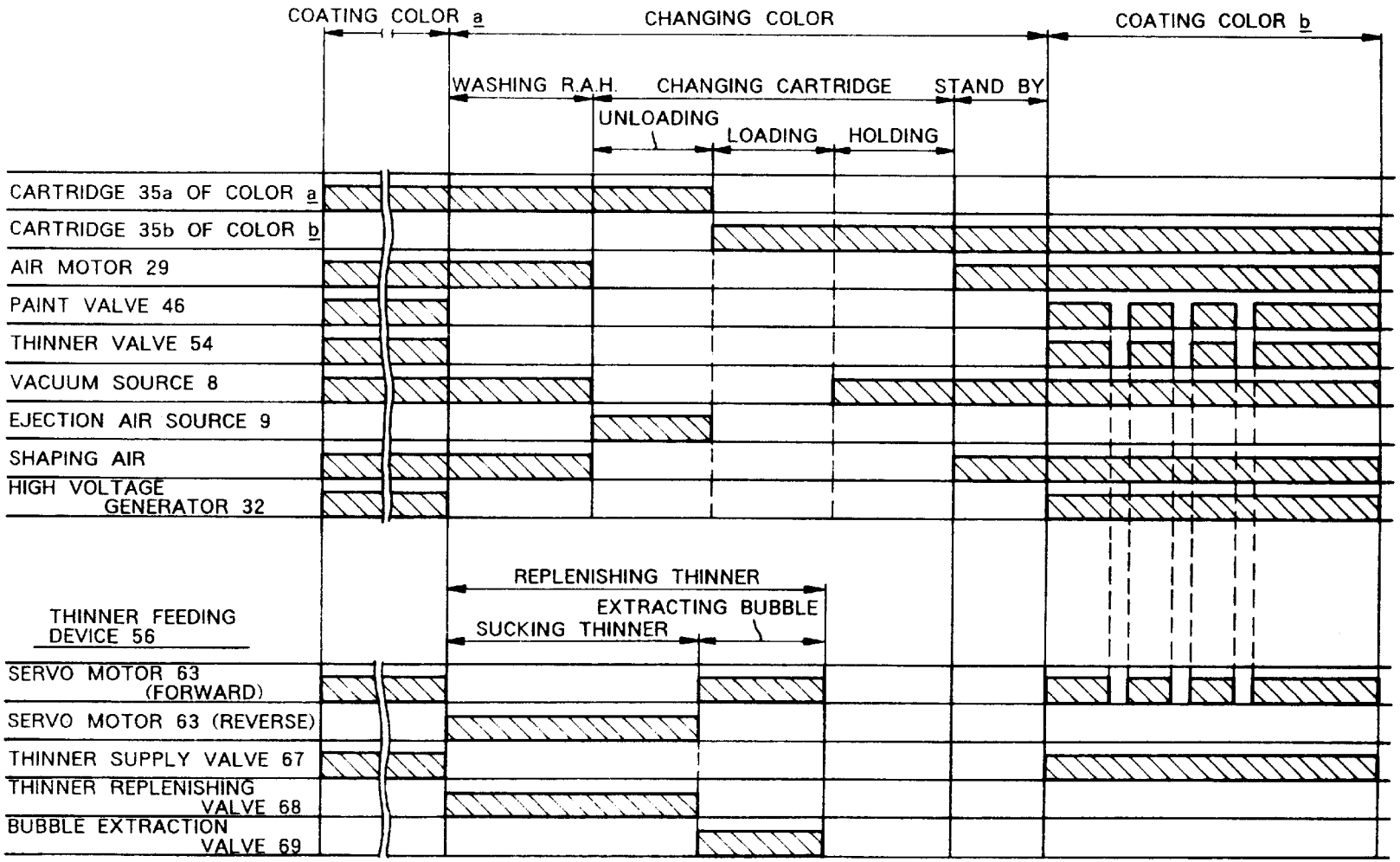
FIG. 11 is an operational time chart of the rotary atomizing head type coating system.

Therefore, in the course of a coating operation, the opening and closing motions of the paint valve 46 and of the thinner valve 54 are controlled in synchronism with actuation and de-actuation of the servo motor 63 as shown in FIG. 11. More particularly, when the servo motor 63 is stopped to hold paint spraying temporarily, the paint valve 46 is closed to shut off the paint supply passage 39A of the feed tube 39, and at the same time the thinner valve 54 is closed to shut off the thinner passage 48 on the side of the housing.

Accordingly, when paint spraying is stopped, no pressure acts on the thinner in the thinner passage 43 and thinner reservoir chamber 42 on the side of the cartridge to suspend the outflow of paint from the paint supply passage 39A of the feed tube 39. This makes it possible to turn on and off the paint supply to the rotary atomizing head 30, namely, to turn on and off the paint spraying operation definitely in a reliable manner.

Thus, according to the present embodiment of the invention, the paint supply from the feed tube 39 to the rotary atomizing head 30 turned on and off by the paint valve 46 which is provided on the cartridge 35 to open and close the paint supply passage 39A of the feed tube 39, while the thinner supply to the thinner chamber 42 is turned on and off by the thinner valve 54 which is provided on the housing 22 to open and close the thinner passage 48 on the side of the housing. Therefore, in response to a command signal to start or to stop spraying, the paint spraying operation can be started or stopped immediately since the paint valve 46 and the thinner valve 54 are opened or closed on such a command signal.

Consequently, the above-described arrangements make it possible to form coatings of improved quality, which are uniform in thickness, and to improve the reliability of the coating machine 21. Besides, it becomes possible to prevent paint drips from the feed tube 39 when the cartridge 35 is extracted from the housing 22 for replacement.

In addition, the use of replaceable paint cartridges 35, which are each filled with a paint, permits to omit paint hoses which are otherwise required to supply paint from a paint storage or source and to preclude leaks of high voltage through paint, obviating the necessity for using an insulation structure (a voltage block structure) for the paint storage or source.

In feeding paint from the paint reservoir chamber 41 to the rotary atomizing head 30, the piston 40 is displaced by thinner which is a non-compressive fluid. Therefore, the piston 40 can be displaced accurately at a constant speed to form coatings which are improved in quality, improved especially in uniformity in thickness, without adding a flowmeter and control valves for this purpose. This will lead to enhanced reliability and reductions in cost.

Further, the thinner feeding device 56 is arranged as a positive displacement pump means or a piston type pump, feeding thinner quantitatively to the thinner chamber 42 by the piston 59 which is displaced by the servo motor 63. Accordingly, the thinner feeding device 56 can feed paint to the rotary atomizing head 30 stably from the paint reservoir chamber 41, delivering paint through the feed tube 39 at a constant rate to form coatings of improved quality.

Furthermore, the paint valve 46 and thinner valve 54 are arranged as an air pilot operated control valve in the present embodiment. Therefore, both of paint valve 46 and thinner valve 54 are simple in construction to make piping work simple as well, ensuring improved working efficiency in addition to reductions in cost.

Further, since the opening and closing motions of the paint valve 46 and thinner valve 54 are synchronized with starting and stopping motions of the servo motor 63 of the thinner feeding device 56, it becomes possible to control the paint valve 46 and thinner valve 54 more precisely in relation with on- and off-timings of the paint spraying operation for improving the quality of coatings all the more.

Further, the cylinder 36 can be oriented into a predetermined position relative to the cartridge mount portion 26 in the circumferential direction by coupling engagement of the female and male connecting portions 26B and 26C, which are provided on the cartridge mount portion 26, with the male and female connecting portions 36A and 36B on the side of the cylinder 36.

Further, similarly by coupling engagement of the conical projection 38 on the cartridge 35 with the conical recess 27B which is provided at a deep position on the cartridge mount portion 26, the paint cartridge 35 can be oriented into a predetermined position relative to the cartridge mount portion 26 of the housing 22 in the axial and radial directions, helping to enhance the efficiency of assembling work and to shorten the time required for the color changing work.

Moreover, through the air suction passage 50 which is opened at the bottom of the cartridge mount portion 26, air is sucked out of the vacuum space 51 between the cartridge mount portion 26 and the cylinder 36 to hold the paint cartridge 35 fixedly in position on the housing 22 with suction force, thereby preventing the paint cartridge 35 from getting loose. Besides, upon supplying air to the vacuum space 51 through the ejection air supply passage 52, the paint cartridge 35 is released from the cartridge mount portion 26 as a result of cancellation of the vacuum grip and therefore can be unloaded or dismantled from the housing 22.

On the other hand, the quick coupling 44, which is provided at the open end of the thinner passage 43 on the side of the paint cartridge, is opened when the cartridge 35 is loaded on the cartridge mount portion 26 and closed as soon as the cartridge 35 is unloaded therefrom, thereby preventing thinner from dripping while loading or unloading the cartridge 35 on or from the cartridge mount portion 26, improving the efficiency and environmental conditions of the loading and unloading work.

Further, since the air passages 33 for the turbine air, bearing air, brake air and shaping air are formed within the neck portion 23 of the housing 22, utilizing the internal space of the housing 22 for these air passages 33 instead of using air hoses or the like, the assembling work can be simplified by omitting connections of air hoses and the system can be built into an uncomplicated form in outer appearance.

Further, since the high voltage generator 32 is built into the neck portion 23 of the housing 22, utilizing the internal space of the housing 22, the system as a whole can be arranged in a compact form.

Furthermore, since the piston 40 is slidably fitted into the cylinder 36 of the paint cartridge 35 as a movable partition wall and arranged to be pushed by thinner which is supplied thereto through the thinner passage 43 on the side of the cartridge, the cartridge 35 can be simplified in construction to make the assembling work easier and to permit reductions in cost.

Figure 12:
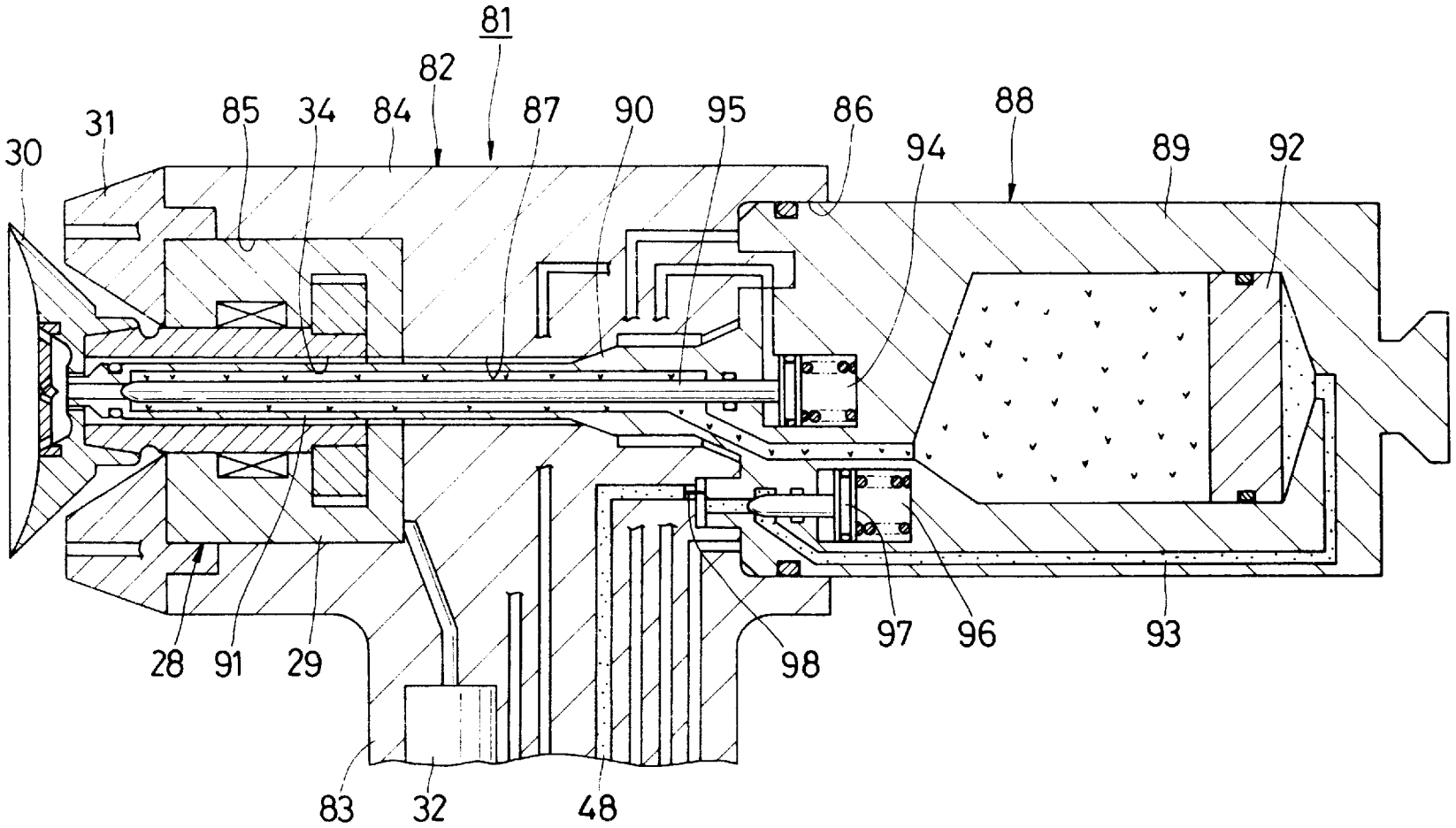
FIG. 12 is a vertical sectional view of a rotary atomizing head type coating system, adopted as a second embodiment of the present invention.

Referring now to FIG. 12, there is shown a second embodiment of the present invention which is characterized in that the thinner valve is provided on the side of the paint cartridge as a paint-extruding liquid valve. In the following description, those component parts which are common with the foregoing first embodiment are simply designated by common reference numerals or characters to avoid repetitions of same explanations.

Denoted at 81 is a rotary atomizing head type coating system according to this embodiment, and at 82 is a housing of the coating system 81. Substantially in the same manner as the housing 22 in the foregoing first embodiment, the housing 82 of this embodiment is constituted by a neck portion 83 and a head portion 84. The head portion 84 is formed with a coating machine mount portion 85, a cartridge mount portion 86, and a feed tube passage hole 87 on the side of the housing. In the case of the housing 82 according to the present embodiment, however, the thinner valve receptacle portion 53 as in the housing 22 of the first embodiment is abolished in this case.

Indicated at 88 is a paint cartridge which is employed in this embodiment. Similarly to the paint cartridges 35 of the first embodiment, a plural number of cartridges 88 are provided for different paint colors a, b, . . . and n. Each paint cartridge 88 is largely constituted by a cylinder 89, a conical projection 90, a feed tube 91, a piston 92, a thinner passage 93 on the side of the cartridge, and a paint valve receptacle portion 94 which accommodated a paint valve 95. The cartridge 88 of this embodiment, however, differs from the cartridge 35 of the first embodiment in that a thinner valve receptacle portion 96 is located within the length of the thinner passage 93 on the side of the cartridge and in a position in a fore end portion of the cylinder 89.

Indicated at 97 is a thinner valve which is provided in the thinner valve receptacle portion 96 to serve as an extruding liquid valve. Similarly to the thinner valve 54 in the first embodiment, the thinner valve 97 is biased to normally shut off the thinner passage 93 on the side of the cartridge, and to put the thinner passage 93 into communication only when pilot air supplied.

The quick coupling 98 which is provided at the open end of the thinner passage 48 on the side of the housing is arranged in the same way as the quick coupling 44 in the first embodiment.

The present embodiment, with the arrangements just described, can produce substantially the same operational effects as the foregoing first embodiment.

Figure 13:
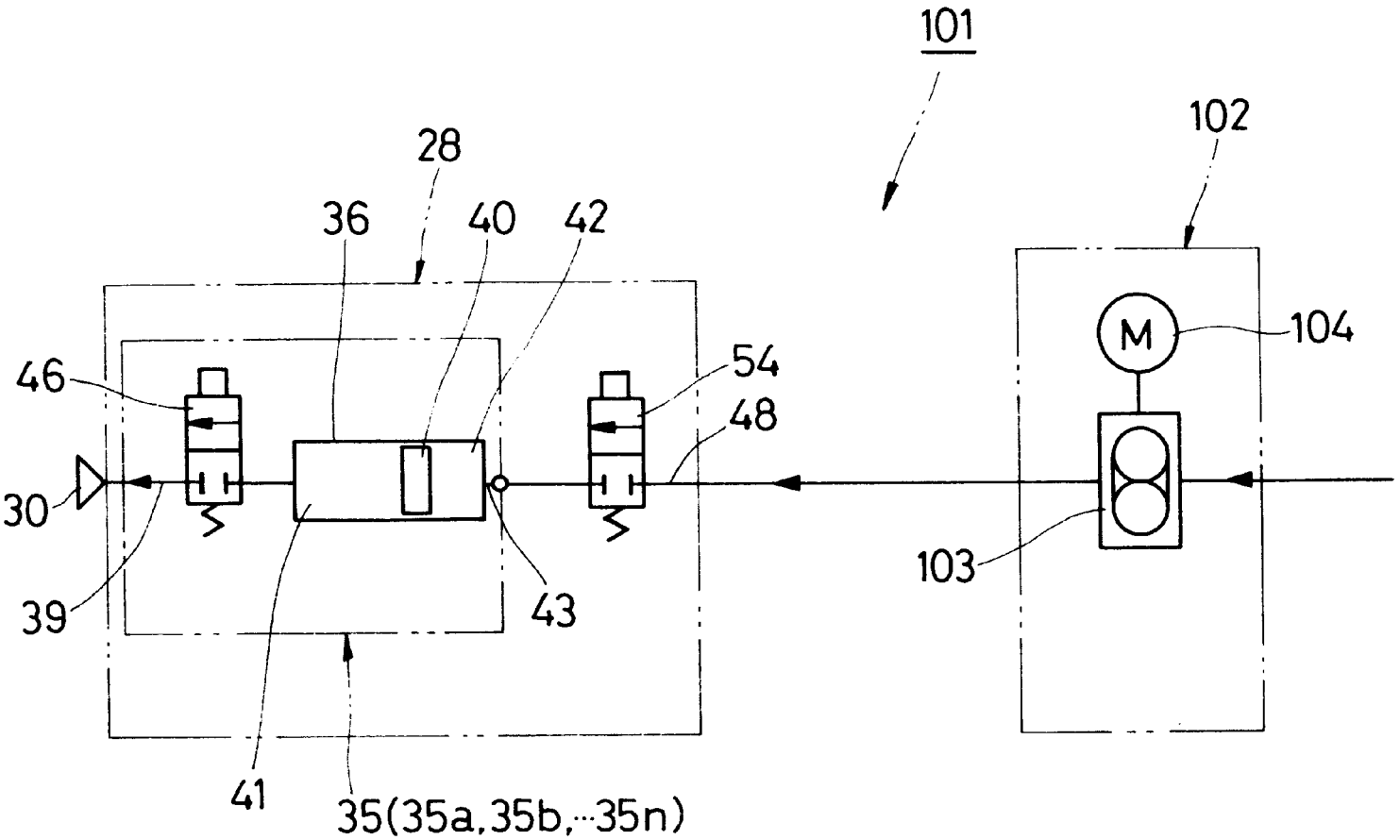
FIG. 13 is a circuit diagram employed in a third embodiment of the rotary atomizing head type coating system according to the present invention.

Referring now to FIG. 13, there is shown a third embodiment of the present invention, which is characterized in that an extruding liquid feeding means is constituted by a gear pump and a servo motor which rotationally drives the gear pump. In the following description, those component parts which are common with the above-described first embodiment are simply designated by common reference numerals or characters to avoid repetition of same explanations. Besides, various component parts are indicated only by reference numerals or diagrammatic symbols for the sake of simplicity of illustration.

Indicated at 101 is a rotary atomizing head type coating system according to the present embodiment, and at 102 is a thinner feeding device which is provided on the coating system 101 as an extruding liquid feeding means. The thinner feeding device 102 is arranged as a positive displacement pump, including a gear pump 103 and a servo motor 104 which rotationally drives the gear pump 103 to feed thinner quantitatively to the cartridge 35.

In this instance, similarly to the servo motor 63 in the above-described first embodiment, the servo motor 104 is controlled to start and stop in synchronism with opening and closing motions of the paint valve 46 and the thinner valve 54.

Thus, by the gear pump 103 which is driven at a constant rotational speed by the servo motor 104, thinner is quantitatively supplied from the thinner feeding device 102 to the cartridge 35.

The present embodiment, with the arrangements just described, can also produce almost the same operational effects as each one of the foregoing embodiments. Especially in the case of this embodiment employing commercially available gear pump 103 for the thinner feeding device 102, it becomes possible to simplify its construction and to realize reductions in cost. The gear pump 103 can be started and stopped in synchronism with opening and closing motions of the paint valve 46 and thinner valve 54 to turn on and off paint spraying in accurate timings.

Figure 14:
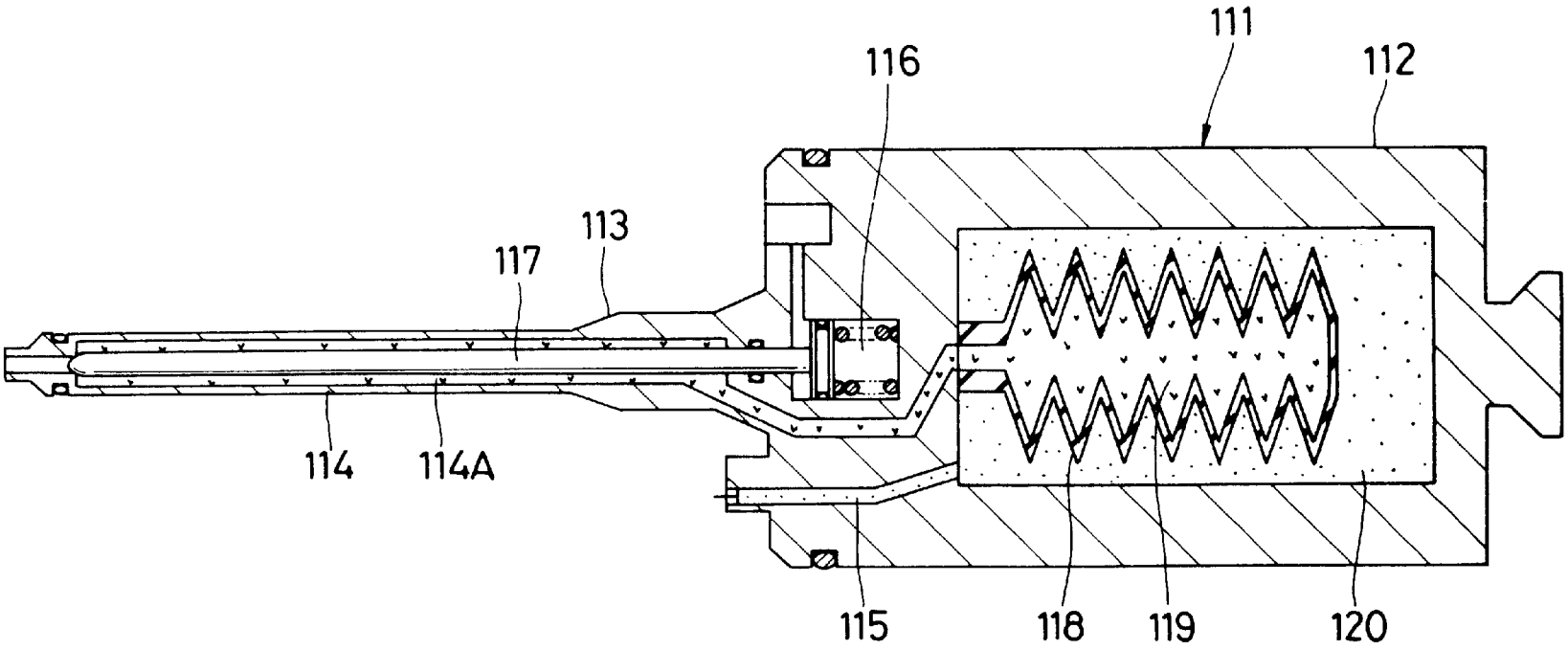
FIG. 14 is a vertical sectional view of a paint cartridge employed in a modification of the present invention.

FIG. 14 illustrates a modification of the paint cartridge according to the present invention, which can be employed in place of the above-described paint cartridge 35. In this case, the paint cartridge is provided with a movable partition wall in the form of a bellows tube.

More particularly, indicated at 111 is the paint cartridge of a modified construction. Similarly to the paint cartridge 35 in the first embodiment, the paint cartridge 111 is largely constituted by a cartridge cylinder 112, a conical projection 113 which is provided at the fore end of the cylinder 112, a feed tube 114 which is extended axially from and on the front side of the conical projection 113, a thinner passage or conduit 115 on the side of the cartridge, and a paint valve receptacle portion 116 which accommodates a paint valve 117.

This modification, however, differs from the cartridge 35 of the first embodiment in that the cylinder 112 of the cartridge 111 is internally provided with bellows to serve as a movable partition wall as described hereafter.

Indicated at 118 is a bellows tube which is provided internally of the cylinder 112 as a movable partition wall. The bellows tube 118 is foldably stretchable in the axial direction and internally defines a paint reservoir chamber 119 in communication with a paint supply passage 114A of the feed tube 114. Defined between the bellows tube 118 and the cylinder 112 is a thinner chamber 120 which functions as an extruding liquid chamber.

The paint cartridge 111, with the arrangements just described, can produce substantially the same operational effects as the counterpart in the foregoing embodiments. Especially in the case of the cartridge 111 employing the bellows tube 118 as a movable partition wall, the paint and thinner can be definitely separated from each other, completely precluding the possibilities of the thinner in the cylinder creeping into the paint to degrade the quality of coatings.

In the foregoing embodiments, the coating system 21, 81 or 101 is shown as being mounted on the horizontal arm 4 of the coating robot 1. However, the present invention is not limited to this particular form shown. For example, if desired, the coating system 21, 81 or 101 may be mounted on a reciprocator or the like. Further, although a movable partition wall is constituted by the piston 40 in the first to third embodiments and by the bellows tube 118 in the above-described modification, it may be realized in other forms, for example, may be in the form of an inflatable bag of resilient material having an internal space thereof communicated with the feed tube.

Figure 15:
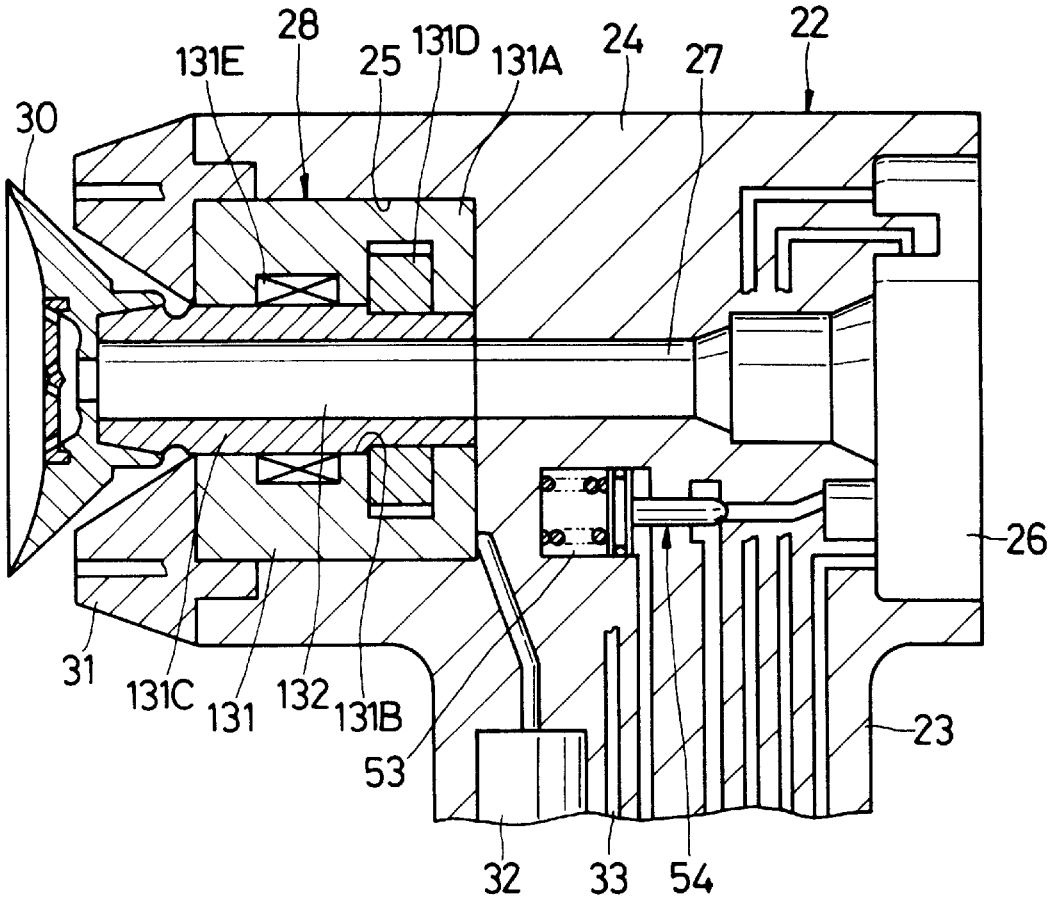
FIG. 15 is a vertical sectional view of an air motor and a housing employed in a modification of the present invention.

Further, in the foregoing embodiments, the axial bore 29B of the air motor 29 is shown as being formed in a stepped form including a rear small-diameter portion and a front large-diameter portion, and the rotational shaft 29C is received in the large-diameter portion of the axial bore 29B. However, it is to be understood that the present invention is not limited to this particular example. For example, as shown in the modification of FIG. 15, an air motor 131 may be constituted by a motor case 131A with an axial bore 131B, which has almost a uniform diameter in the axial direction, and a rotational shaft 131C which is extended through the entire length of the axial bore 131B. In this instance, a feed tube passage hole 132 on the side of the coating machine is provided internally of the rotational shaft 131C in coaxial relation with the feed tube passage hole 27 on the side of the housing.

Further, although thinner is used as an extruding liquid by way of example in the foregoing embodiments, water or other extruding liquid may be applied depending upon the type of paint or high voltage application system to be used.

Furthermore, in the foregoing embodiments, two or more spare paint cartridges 35, 88 or 111 may be provided for each color if desirable in consideration of the convenience or efficiency of the cartridge changing operation in a continuous coating operation in the same color.

As clear from the foregoing particular description, according to the present invention, a paint valve is provided on each paint cartridge to communicate or shut off a paint supply passage in a feed tube, thereby turning on and off paint supply to a rotary atomizing head from the feed tube, while an extruding liquid valve is provided within the length of an extruding liquid passage which is provided either on the side of a housing or on the side of the paint cartridge, thereby turning on and off extruding liquid supply to an extruding liquid chamber within the cartridge. Therefore, the paint spray is turned off as soon as the paint valve is closed to shut off the paint supply passage in the feed tube, thereby cutting off the paint supply to the rotary atomizing head. Besides, the supply of the extruding liquid to the extruding liquid chamber is cut off as soon as the extruding liquid valve is closed to shut off the extruding liquid passage either on the side of the housing or on the side of the paint cartridge. At the time of stopping paint spraying, the supply of paint as well as the supply of the extruding liquid can be immediately cut off by way of the paint valve and the extruding liquid valve, respectively.

As a consequence, it becomes possible to turn on and off the paint supply to the rotary atomizing head definitely in a secure manner, and to form coatings of improved quality, which are uniform in thickness, thereby reflecting higher reliability of the coating system. In addition, paint drips from the feed tube, which might lead to coating defects, can be prevented at the time of extracting the paint cartridge from the housing for replacement. Further, it also becomes possible to prevent leaks of high voltage through paint thanks to the omission of a paint hose which would be normally required for connection to a paint reservoir or source. Furthermore, with regard to the movable partition wall in the paint cartridge, which is displaced by an extruding liquid, the piston can be displaced accurately at a constant speed by the use of a non-compressive liquid.

What is claimed is:

1. A rotary atomizing head type coating system, including:

a housing having a coating machine mount portion on the front side and a cartridge mount portion on the rear side thereof;

a coating machine adapted to be mounted on said coating machine mount portion of said housing, and having an air motor with a rotational shaft and a rotary atomizing head mounted on a front end portion of said air motor;

a feed tube passage hole provided internally of and axially through said rotational shaft of said air motor, and having a front end opened into said rotary atomizing head and a rear end opened into said cartridge mount portion of said housing; and a plural number of paint cartridges containing paint of different colors in respective cartridge cylinders, each one of said paint cartridges being adapted to be replaceably and selectively loaded on said cartridge mount portion of said housing and having a feed tube extended axially forward from a front end portion of said cartridge cylinder for placement in said feed tube passage hole; characterized in that said coating system comprises:

on the side of said cartridge, a movable partition wall dividing said cylinder into a paint reservoir chamber in communication with said feed tube and an extruding liquid chamber, an extruding liquid passage for supplying an extruding liquid to said extruding liquid chamber, and a paint valve to turn on and off paint supply from said feed tube to said rotary atomizing head;

on the side of said housing, an extruding liquid passage in communication with said extruding liquid passage on the side of said cartridge; and an extruding liquid valve provided within the length of said extruding liquid passage either on the side of said cartridge or on the side of said housing to turn on and off extruding liquid supply to said extruding liquid chamber.

2. A rotary atomizing head type coating system as defined in claim 1, further comprising an extruding liquid feeding means connected to said extruding liquid passage on the side of said housing and adapted to supply an extruding liquid quantitatively to said cartridge.

3. A rotary atomizing head type coating system as defined in claim 2, further comprising a coating robot with vertical and horizontal arms, said housing of said coating system being mounted on a fore end portion of said horizontal arm of said coating robot, and said extruding liquid feeding means being mounted on said vertical arm.

4. A rotary atomizing head type coating system as defined in claim 2, wherein said extruding liquid feeding means is in the form of a positive displacement pump means constituted by a piston type pump having a cylinder and a piston, and a servo motor for displacing said piston of said piston type pump.

5. A rotary atomizing head type coating system as defined in claim 4, wherein said extruding liquid feeding means comprises, in a fore end portion of said cylinder of said piston type pump and in communication with each other, an extruding liquid supply conduit connected to said extruding liquid passage on the side of said housing, an extruding liquid replenishing conduit connected to an extruding liquid source, and a drain conduit connected to a drain side, said extruding liquid supply conduit being provided with an extruding liquid supply valve to be opened only when said extruding liquid in said cylinder is supplied to said paint cartridge, said extruding liquid replenishing conduit being provided with a liquid replenishing valve to be opened only when said extruding liquid is replenished to said cylinder, and said drain conduit being provided with an air bubble extraction valve to be opened when removing air bubbles from an extruding liquid replenished to said cylinder.

6. A rotary atomizing head type coating system as defined in claim 4, wherein said paint valve and said extruding liquid valve are adapted to open and close in synchronism with start and stop of said servo motor.

7. A rotary atomizing head type coating system as defined in claim 2, wherein said extruding liquid feeding means is in the form of a positive displacement pump means constituted by a gear pump and a servo motor for rotationally driving said gear pump.

8. A rotary atomizing head type coating system as defined in claim 7, wherein said paint valve and said extruding liquid valve are adapted to open and close in synchronism with start and stop of said servo motor.

9. A rotary atomizing head type coating system as defined in claim 1, wherein said paint valve is in the form of an air pilot operated control valve normally biased in a closing direction by a valve spring and adapted to open upon applying pilot air thereto from outside to open a paint flow through said feed tube.

10. A rotary atomizing head type coating system as defined in claim 1, wherein said extruding liquid valve is in the form of an air pilot operated control valve normally biased in a closing direction by a valve spring and opened upon application of pilot air thereto from outside to open an extruding liquid flow in said extruding liquid passage.

11. A rotary atomizing head type coating system as defined in claim 1, wherein said cartridge mount portion of said housing is provided with a positioning coupler portion for engagement with a complementarily shaped positioning coupler portion on a front end portion of said cylinder of said paint cartridge.

12. A rotary atomizing head type coating system as defined in claim 1, wherein said cartridge mount portion of said housing further comprises a vacuum space to be defined thereon in association with said cylinder of said cartridge when said cylinder is mounted in position on said cartridge mount portion, and an air suction passage opened to said vacuum space to suck air out of said vacuum space, holding said cartridge fixedly against said cartridge mount portion of said housing with suction force.

13. A rotary atomizing head type coating system as defined in claim 1, wherein another feed tube passage hole is provided on said housing in coaxial relation with said feed tube in said rotational shaft.

14. A rotary atomizing head type coating system as defined in claim 1, wherein said extruding liquid valve is provided in said extruding liquid passage on the side of said housing, and said extruding liquid passage on the side of said cartridge is provided with a valved quick coupling in an open terminal end portion thereof, said quick coupling being opened only when said paint cartridge is fully and fixedly coupled with said cartridge mount portion of said housing.

15. A rotary atomizing head type coating system as defined in claim 1, wherein said extruding liquid valve is provided in said extruding liquid passage on the side of said cartridge, and said extruding liquid passage on the side of said housing provided with a valved quick coupling in an open terminal end portion thereof, said valved quick coupling being opened only when said paint cartridge is fully and fixedly coupled with said cartridge mount portion of said housing.

* * * * *